US009133683B2

(12) United States Patent
Dyer et al.

(10) Patent No.: US 9,133,683 B2
(45) Date of Patent: Sep. 15, 2015

(54) CHEMICALLY TARGETED CONTROL OF DOWNHOLE FLOW CONTROL DEVICES

(75) Inventors: Stephen Dyer, Al-Khobar (SA); Athar Ali, Al-Khobar (SA); Frank F. Chang, Al-Khobar (SA); Xiangdong Qiu, Dhahran (SA); Kuo-Chiang Chen, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 816 days.

(21) Appl. No.: 13/185,957

(22) Filed: Jul. 19, 2011

(65) Prior Publication Data

US 2013/0020088 A1 Jan. 24, 2013

(51) Int. Cl.

| | |
|---|---|
| ***E21B 43/12*** | (2006.01) |
| ***E21B 34/06*** | (2006.01) |
| ***E21B 41/00*** | (2006.01) |
| *E21B 34/00* | (2006.01) |

(52) U.S. Cl.

CPC ..... *E21B 34/063* (2013.01); *E21B 41/0035* (2013.01); *E21B 43/12* (2013.01); *E21B 2034/007* (2013.01)

(58) Field of Classification Search

CPC . E21B 43/12; E21B 2034/007; E21B 34/063; E21B 41/0035

USPC ..... 166/373, 386, 317

See application file for complete search history.

(56) References Cited

U.S. PATENT DOCUMENTS

| | | | | |
|---|---|---|---|---|
| 5,803,178 | A * | 9/1998 | Cain | 166/306 |
| 6,302,206 | B1 * | 10/2001 | Wilson et al. | 166/263 |
| 6,622,794 | B2 | 9/2003 | Zisk, Jr. | |
| 7,828,065 | B2 | 11/2010 | Ross et al. | |
| 7,870,906 | B2 | 1/2011 | Ali | |
| 7,942,206 | B2 * | 5/2011 | Huang et al. | 166/373 |
| 8,230,731 | B2 | 7/2012 | Dyer et al. | |
| 8,322,426 | B2 * | 12/2012 | Wright et al. | 166/317 |
| 2004/0014607 | A1 | 1/2004 | Sinclair et al. | |
| 2007/0181224 | A1 | 8/2007 | Marya et al. | |
| 2008/0105438 | A1 | 5/2008 | Jordan et al. | |
| 2008/0210423 | A1 | 9/2008 | Boney | |
| 2009/0101354 | A1 * | 4/2009 | Holmes et al. | 166/373 |
| 2009/0151949 | A1 | 6/2009 | Marya et al. | |
| 2011/0048743 | A1 | 3/2011 | Stafford et al. | |
| 2011/0067889 | A1 | 3/2011 | Marya et al. | |
| 2012/0118564 | A1 * | 5/2012 | Gomes et al. | 166/250.12 |
| 2014/0101918 | A1 | 4/2014 | Woiceshyn et al. | |

FOREIGN PATENT DOCUMENTS

| | | |
|---|---|---|
| EP | 1546506 | 1/2009 |
| WO | 2011153636 | 12/2011 |

* cited by examiner

*Primary Examiner* — Robert E Fuller

(74) *Attorney, Agent, or Firm* — Bridget M. Laffey

(57) ABSTRACT

Systems and methods use enhanced flow control devices that can be selectively closed completely or have its effective flow area reduced to restrict production (or injection) by use of a chemical trigger mechanism. In addition, some of the systems deploy specific targeted chemical tracers, dissolvable in the unwanted production fluid (e.g., water or gas). These chemical tracers once dissolved will enter the production stream and be identified at the surface. An appropriate chemical trigger can be placed, for example, by pumping down through the tubing and utilizing intelligent completion valve to place the chemical, or by spotting with coiled tubing and bullhead to the formation. The chemical trigger will only trigger the active chemical in the appropriate flow control device.

11 Claims, 21 Drawing Sheets

| Base material | | Trigger Chemicals | | | | | | | | | | | | | | | | |
|---|---|---|---|---|---|---|---|---|---|---|---|---|---|---|---|---|---|---|
| | | Non- polar solvents | | | | | | Polar aprotic solvents | | | | | Polar protic solvents | | | | | |
| | | Toluene | TCB | Pentane | chloroform | DEE | C- hexane | ODCB | THF | Acetone | DMF | DMSO | Formic acid | Acetic acid | HCl | m-cresol | $HNO_3$ | DMAC |
| Organic Materials (polymers) | PS | Y | Y | Y | Y | Y | N | Y | Y | Y | Y | Y>130C | N | N | N | N | Y (HT) | N |
| | LDPE | Y>75 C | Y | N | N | N | N | Y | Y>70C | N | N | N | N | N | N | N | Y | N |
| | HDPE | N | Y | N | N | N | N | Y | Y>16C | N | N | N | N | N | N | N | Y (HT) | N |
| | PVC | Y(HT) | N | N | N | N | N | N | Y | N | Y | P Y | N | N | N | N | Y | N |
| | PET | N | N | N | N | N | N | N | N | N | N | Y | N | N | N | Y | Y(HT) | N |
| | Nylon | N | N | N | N | N | N | N | N | N | N | Y | N | N | N | Y | Y (HT) | Y |
| | Epoxy | Y | N | N | Y | N | N | N | Y | N | N | Y | N | N | N | N | Y | N |
| | PVDF | N | N | N | N | N | Y | N | N | N | Y | Y | N | N | N | N | Y (HT) | N |
| Inorganic materials | Copper | N | N | N | N | N | N | N | N | N | N | N | N | N | N | N | Y | N |
| | Car-bonate | N | N | N | N | N | N | N | N | N | N | N | Y | Y | Y | N | Y | N |
| | Alumi-num | N | N | N | N | N | N | N | N | N | N | N | Y | Y | Y | N | Y | N |

Table 1

*Fig. 12*

CHEMICALLY TARGETED CONTROL OF DOWNHOLE FLOW CONTROL DEVICES

FIELD

This patent specification generally relates to downhole flow control and injection devices. More particularly, this patent specification relates to selective control of flow control and injection devices installed in a wellbore using targeted chemistry.

BACKGROUND

Intelligent and/or segmented completions such as staged fracture completions and/or multi-zone injection wells have been utilized quite extensively in the oilfield since the late 1990's. Their application has become more widespread since the 2004 oil price increase and worldwide technology acceptance. The main applications in the Middle East for intelligent completions' have been in controlling multi-lateral completions where each flow control valve is placed at the junction for each lateral leg—often an open hole lateral. These types of intelligent completion applications allow a lateral to be choked back or shut-off should unwanted production occur. This manipulation of the well completion can be done without resorting to intervention through coiled tubing or tractor operations which are themselves inherently risky operations. Intelligent completions are conventionally operated by use of hydraulic or electric control lines run in with the completion, adding to the complexity of installation.

In parallel with this technology acceptance, passive inflow control systems, (hereinafter referred to as "ICD"s) and/or injection control systems have become extremely popular for open-hole long horizontal completions especially in locations such as in the Middle East carbonate reservoirs. The main drivers have been controlling fracture contribution to the wellbore and balancing for wellbore hydraulics effects in long horizontal or deviated wells.

In addition selective segmented completions have been used widely to facilitate the stimulation treatment of multi-zone and/or long horizontal wells. In this case, the selectivity is provided by a series of valves that is actuated to direct stimulating fluids (acid, water, sand, proppant, polymer, solvents or other such fluids) for the purpose of selectively injecting into the specific segment of the well being targeted.

The ICD style of completion is often particularly attractive to the operator and especially the drilling departments due to the relatively low risk and cost of the installation phase. However the long-term benefits of the passive inflow control completion system are compromised should water production enter the wellbore. The ICD will limit the production of water, but does not allow it to be effectively shut off without intervention. Similarly, current ICD type completions complicate access to the formation for treatments such as stimulation treatments, clay stabilization, water conformance injection etc.

In addition, an ICD is by default designed before installation phase. Once the ICD is in place, there is little chance to change its characteristics (flow versus pressure differential), and therefore their success relies on the accurate characterization of the formation conductivity with the borehole.

Attempts have been made to provide dissolvable members. Commonly-assigned U.S. Patent Application Publ. No. US2007/0181224 discusses reactive alloy materials for targeted control. One composition consists essentially of one or more reactive metals in major proportion, and one or more alloying elements in minor proportion, with the provisos that the composition is high-strength, controllably reactive, and degradable under defined conditions. Compositions may exist in a variety of morphologies, including a reactive metal or degradable alloy processed into an alloy of crystalline, amorphous or mixed structure that may constitute the matrix of other compositions, for instance a composite.

Other attempts have been made to provide dissolvable members to control downhole fluid flow in oilfield applications. For example, commonly-assigned U.S. Patent Application Publ. No. 2009/0151949 discusses self dissolvable alloys for perforating. U.S. Patent Application Publ. No. 2004/0014607 discusses dissolvable encapsulation of chemicals for oilfield treatment purposes. Commonly-assigned U.S. Patent Application Publ. No. 2011/0067889 discusses a hydraulic regulating mechanism for disposal in a well. The mechanism includes a degradable metal based element and a swellable component for hydraulic regulation. The mechanism is configured for ease of setting and removal by allowing degrading of the metal based element upon exposure to certain downhole conditions which may trigger shrinking of the swellable component. Commonly-assigned U.S. Patent Application Publ. No. 2011/0048743 discusses a dissolvable bridge plug configured with components for maintaining anchoring and structural integrity for high pressure applications. Embodiments of the plug are configured such that these components may substantially dissolve to allow for ease of plug removal following such applications. Commonly-assigned U.S. Patent Application Publ. No. 2008/0210423 discusses circulated degradable material assisted diversion methods for well treatment in completed wells. Commonly-assigned U.S. Patent Application Publ. No. 2008/0105438 discusses whipstocks and deflectors comprising a degradable composition.

All of the commonly-assigned patent applications identified above are hereby incorporated by reference herein.

SUMMARY

According to some embodiments, a method of chemically targeting control of flow control devices installed in a wellbore is provided. The method includes introducing a chemical into a wellbore having a plurality of flow control devices installed therein; and causing actuation of a subset of the plurality of flow control devices with a chemical reaction due to the presence of the introduced chemical at the flow control device. According to some embodiments, at least one flow control device is an inflow control device that controls fluid flowing into the wellbore from a zone of the subterranean formation. According to some other embodiments, at least one flow control device is an injection flow control device that controls fluid flowing from the wellbore into a zone of the subterranean formation. The flow control devices can be arranged in a series within a portion of the wellbore, and the introduced triggering chemical flows to each of the flow control devices so as to expose at least a portion of each flow control device to the introduced chemical.

According to some embodiments, the triggering chemical dissolves a mechanical stop retaining a choking member actuated with one or more spring members. According to some other embodiments, the introduced chemical causes an exothermic chemical reaction used to actuate a choking member. According to some other embodiments, the introduced chemical reacts with a material in the flow control device so as to release a plurality of sealing members that seal one or more orifices in a flow control device. According to some other embodiments, the introduced chemical causes swelling of portions within the flow control device so as to restrict fluid flow within the flow control device.

According to some embodiments a separate flowline can be provided to deliver the introduced chemical flows to each flow control device. According to some embodiments, chemical tracers can be used that are associated with each flow control device and are released upon exposure to an undesirable fluid so that identification on the surface of the tracer can be used to indicate which flow control device should be actuated so as to reduce the amount of the undesirable fluid entering the wellbore.

According to some embodiments, a wellbore penetrating a subterranean formation having a plurality of flow control devices installed therein is provided that includes a first flow control device installed in the wellbore being actuable upon exposure to a first triggering chemical, but not upon exposure to a second triggering chemical; and a second flow control device installed in the wellbore being actuable upon exposure to the second triggering chemical, but not actuable upon exposure to the first triggering chemical.

According to some embodiments, the triggering chemical is encapsulated in a material and is positioned upstream from the flow control device. The encapsulating material dissolves or reacts with an unwanted fluid so as to release the triggering chemical and automatically actuate the flow control device. The encapsulating material can also contain a tracer that is detectable on the surface so as to indicate the location of the source of the unwanted fluid. According to some embodiments an indicator chemical is provided that is released only upon actuation of the flow control device, thereby indicating or confirming to an operator on the surface that actuation of the device has occurred.

BRIEF DESCRIPTION OF THE FIGURES

The present disclosure is further described in the detailed description which follows, in reference to the noted plurality of drawings by way of non-limiting examples of embodiments, in which like reference numerals represent similar parts throughout the several views of the drawings, and wherein:

FIG. 12 is a table that presents selected examples chemicals that can be used to provide selective triggering, according to some embodiments;

DETAILED DESCRIPTION

Figure 1:
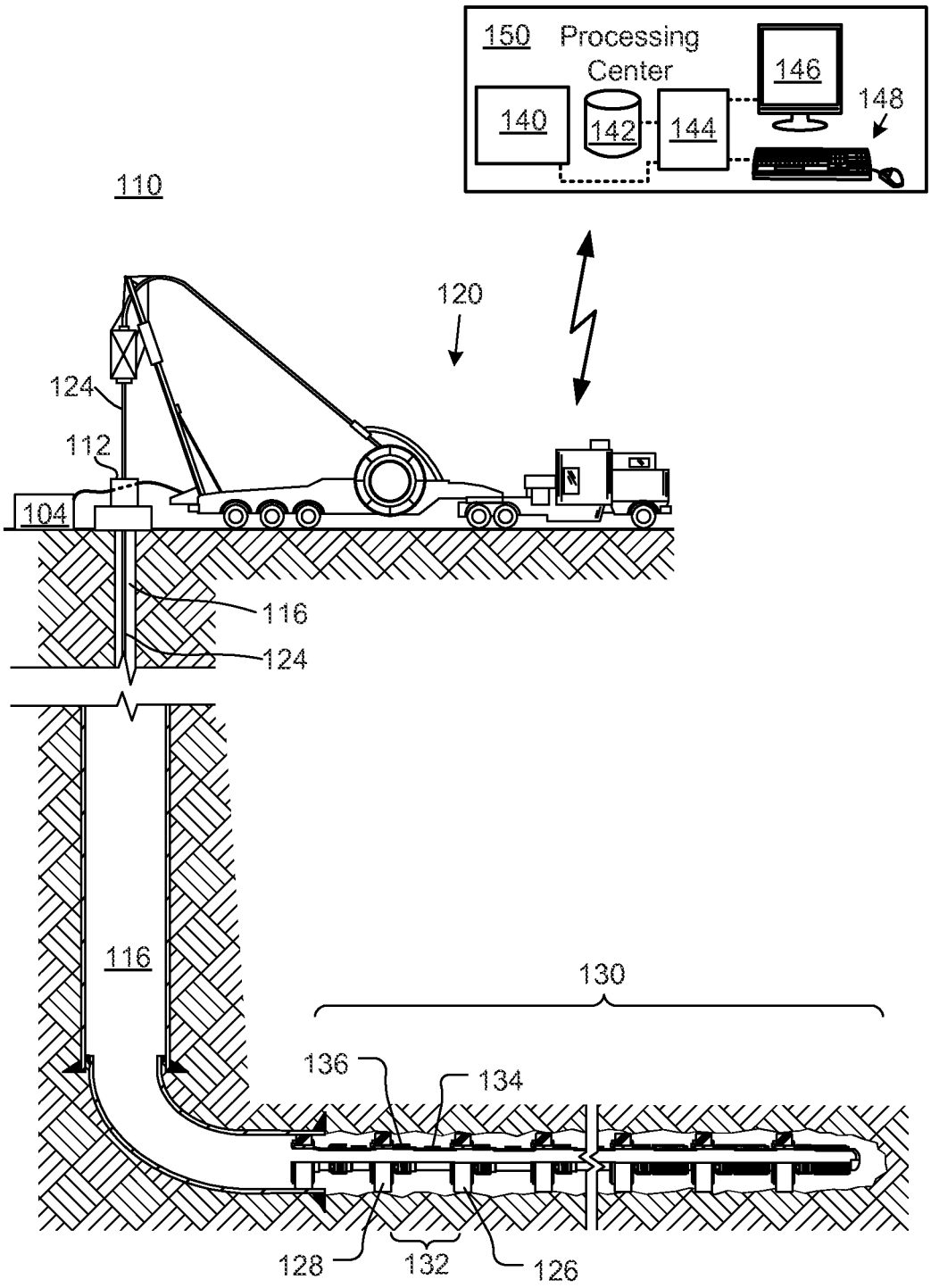
FIG. 1 illustrates an oilfield setting in which chemically targeted control of downhole flow control devices is carried out, according to some embodiments.

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. It being understood that various changes may be made in the function and arrangement of elements without departing from the scope of subject disclosure as set forth in the appended claims.

Specific details are given in the following description to provide a thorough understanding of the embodiments. However, it will be understood by one of ordinary skill in the art that the embodiments may be practiced without these specific details. For example, systems, processes, and other elements in the subject disclosure may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicate like elements.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments. A process may correspond to a method, a function, a procedure, a subroutine, a subprogram, etc. When a process corresponds to a function, its termination corresponds to a return of the function to the calling function or the main function.

Furthermore, embodiments of the subject disclosure may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

According to some embodiments, an enhanced flow control device is provided, that can be selectively closed completely or have its effective flow area reduced to restrict production (or injection) by use of a chemical trigger mechanism. In addition, some of the systems described herein deploy specific targeted chemical tracers, dissolvable in the unwanted production fluid (e.g. water or gas). These chemical tracers once dissolved will enter the production stream and be identified at the surface. The identification will determine which segment of the completion is producing the unwanted fluid.

According to some embodiments, an appropriate chemical trigger is placed, for example, by pumping down through the tubing and utilizing intelligent completion valve to place the chemical, or by spotting with coiled tubing and bullhead to the formation, or by other methods of chemical placement. The chemical trigger will only trigger the active chemical in the appropriate flow control device. This chemical will then change state—dissolve, create thermal reaction, create a pressure swell or expand—which in turn allows a mechanical device to shift position such that a valve in the flow control device closes, or reduces its flow by restricting the flow area by swelling/expansion of the active chemical.

Several designs have been proposed that make a flow control device react automatically to produced water and/or gas (unwanted fluids) to shut off or restrict the flow from the given zone. However, such designs do not provide any downhole information and due to the lack of downhole control, produced fluids can migrate from one segment to the other causing the wrong zones of the wellbore to shut off. Furthermore, the designs are fixed at the time of installation and do not allow the operator the choice to make a decision on how or which segment of the well can be modified after the completion is installed in the wellbore.

In contrast, according to some embodiments, the techniques described herein allow the operator to determine where unwanted fluids are coming from and react to those fluids by making a conscious decision to pump the required chemical trigger for the section of the well producing unwanted fluids to shut it off, or restrict its flow.

According to some embodiments the same type of chemical trigger mechanism is used to open instead of shut a device, or adjust an injection valve characteristics without intervening in the wellbore.

The devices described herein have particular application where it is very risky or impossible to enter the wellbore with coiled tubing or tractors—i.e. extended reach wells, long horizontals, or multilateral legs out from the motherbore. Conventional technology allows completion tubular and Inflow Control Devices (ICD's) to be run and dropped off in open hole lateral legs across from the motherbore, but so far there are limited ways to re-enter these laterals once completed and involve inherently risky intervention.

According to some embodiments, the devices described herein can be run stand-alone as a passive component (with the chemical trigger as an option) or run in combination with an intelligent motherbore completion affording more production sweep control into the wellbore.

According to some embodiments, a chamber that is made of acid soluble material such as carbonate rock is installed in a well section. The chamber contains pre-sized balls that can be released to plug the flow port of the flow control device. The release of the balls is done by injecting an acid that dissolves the chamber. Other materials that can be used for the construction of the chamber include plastic, organic and inorganic compounds that can be dissolved by specific fluids.

According to some other embodiments, an acid soluble material such as carbonate rock is used for the cap/stopper of a spring loaded valve. The valve is set to be normally open when the cap is in place by compressing the spring. An acid can be injected when desired to dissolve the cap/stopper and release the spring such that the valve will be in a closed position. According to some embodiments, the valve is set to be normally closed when the cap is in place by compressing the spring. An acid can be injected when desired to dissolve the cap/stopper and release the spring such that the valve will be in an open position.

According to some other embodiments, a chamber is attached to the flow control device, or the chamber can be an integrated part of the flow control device. The chamber may be made of material that can be dissolved by specific fluids such as acid. The chamber may contain a chemical or chemicals that swell when reacting with a specific injection fluid. As the material in the chamber swell, it fills and seals the chamber such that the valve is effectively shut. The swelling of the material in the chamber can be triggered by fluid adsorption, heat, or chemical reaction.

According to some other embodiments, a chamber resin, wax, or other materials with melting higher than the reservoir temperature is used. According to some embodiments, an exothermic reaction can be created by the reaction between the injection fluid and the chamber to cause temperature increase beyond the melting of the filling materials in the chamber, such as resin. The melted material will fill the fluid flow path, and solidify when the exothermic reaction ceases, to plug off the flow ports or valves. The flow ports or valves can be unplugged when pumping heated fluid to melt the solidified material.

According to some other embodiments a single layer or multiple layers of encapsulated catalysts embedded in resin fluids are used, which release after the injection of certain solvents, to dissolve the encapsulated layer. The released catalysts will allow resins curing to solidify which can block a flowing channel.

According to some other embodiments, the exothermic chemical reactions are used to significantly increase the initial internal volume. A valve can be coupled to a reaction chamber to shut down by expansion.

According to some other embodiments, a flow control device has a chamber containing mixed base-gel fluid, such as a guar-gel system or surfactants. After injecting a metallic salt-crosslinker, a high viscous material is created to block the flow channels. This system is also reversible. This high viscosity gel is degradable by injecting oxidizers. In other words, the closed channels can be re-opened.

According to some other embodiments, a screen flow control device is used which contains a mixture of a chemical or chemicals. After injection with another mixture of a chemical or chemicals, it will produce a lot of precipitates which reduce or block the screen flow control device.

According to some other embodiments, a "hydrogel" is used which can be swelled or de-swelled using a range of different triggers such as pH, ionic strength, temperature and electromagnetic radiation.

According to some embodiments, the placement of the chemical can be through simple bullheading from the surface through the tubing, through coiled tubing to spot it at the nearest appropriate location or through chemical injection control lines run with the completion.

According to some embodiments, the flow path connected to the valve or flow control device contains a permeable porous medium. The porous media can be blocked when desired by injecting a cake forming slurry containing fine particulates or/and fibers, or chemicals that react with the porous medium to form precipitants which seal off the porous medium. Reversely, the flow capacity of the porous medium can be enhanced by injecting a chemical that dissolve portions of the pore network.

FIG. 1 illustrates an oilfield setting in which chemically targeted control of downhole flow control devices is carried out, according to some embodiments. On the surface 110, is a coiled tubing truck 120 located at a wellhead 112. A chemical tank 104, hold fluid which is being introduced into the wellbore 116 through the tubing 124. Tubing 124 enters wellbore 116 via well head 112. At or near the lower end of tubing 124 is a bottom hole assembly (BHA), not shown.

A barefoot section 130 of wellbore 116 is shown having several producing zones. Each producing zone of the wellbore is hydraulically isolated using a number of packers, such as packers 126 and 128 which are used to isolate zone 132. Within each zone, a flow control device 136 is used to allow fluid to enter production tubing. A chemical tracer 134 is provided to indicate the production of undesirable fluid from the zone 132, which can be detected and identified on the surface 110. The flow control devices such as device 136 can be selectively closed using a chemical introduced from truck 120, as will be described in greater detail herein.

Data from truck 120 or otherwise gathered at the wellsite are transmitted to a processing center 150 which includes one or more central processing units 144 for carrying out the data processing procedures as described herein, as well as other processing. Processing center 150 also includes a storage system 142, communications and input/output modules 140, a user display 146 and a user input system 148. According to some embodiments, processing center 150 may be located in a location remote from the wellsite.

Figure 2A:
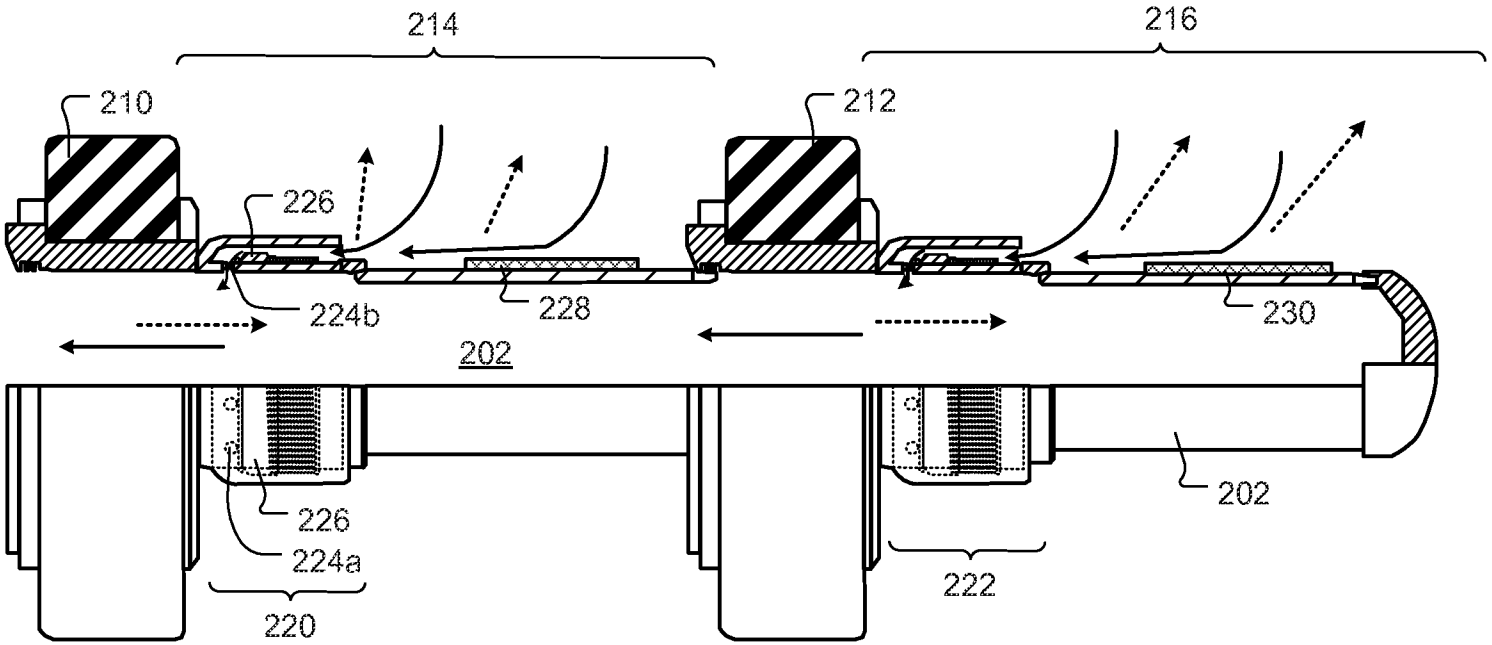
FIGS. 2A-C are quarter cut-away side-views showing some components of a system for targeted control of downhole flow control devices, according to some embodiments.
Figure 2B:
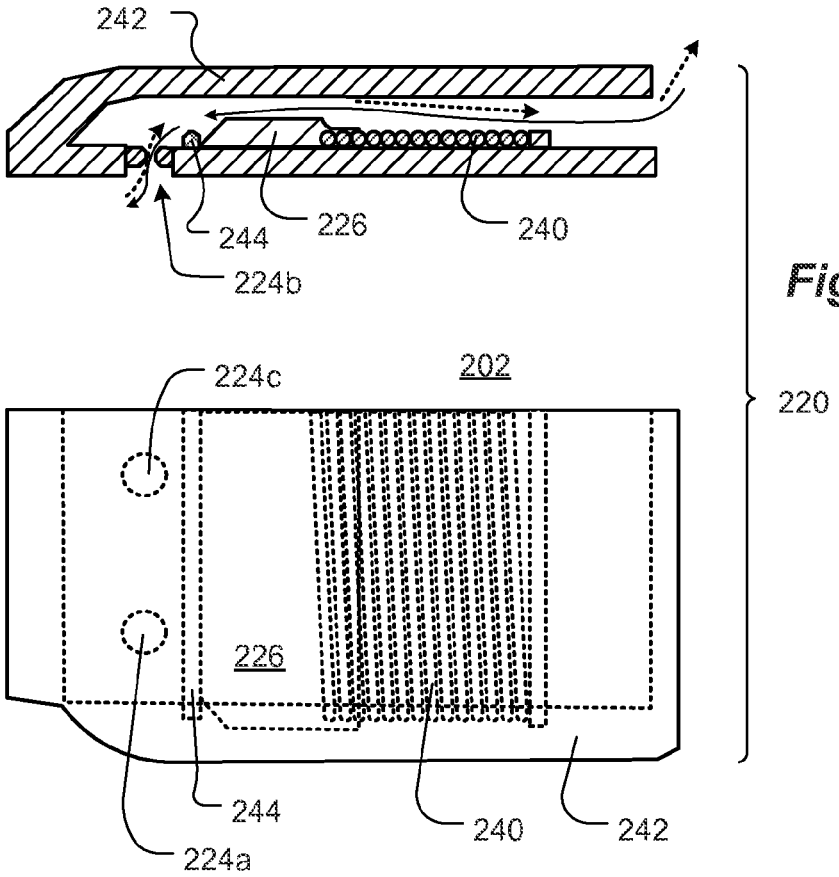
Figure 2C:
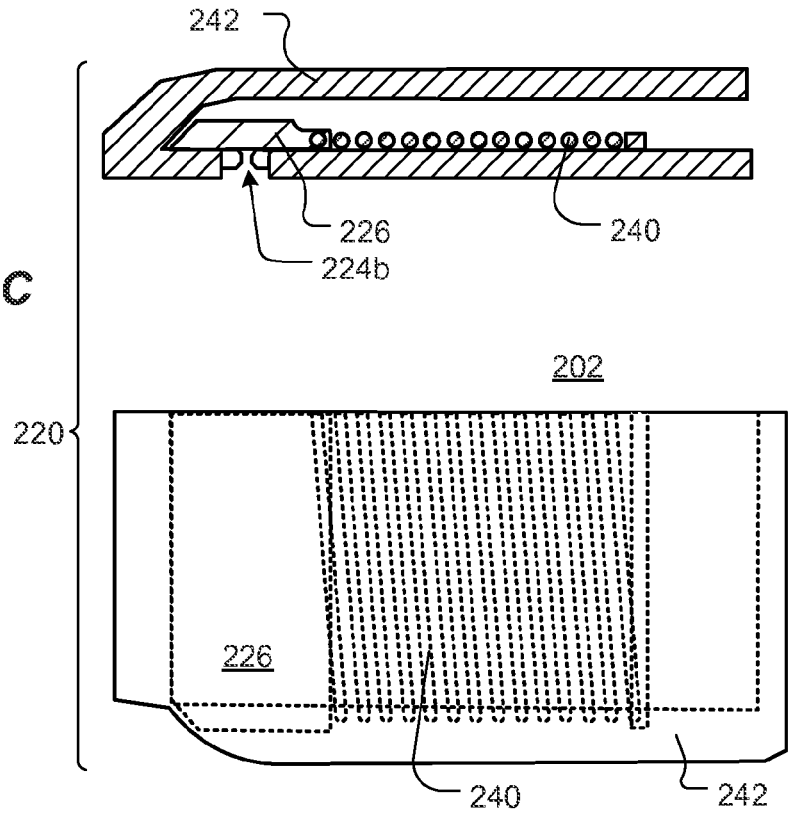

FIGS. 2A-C are quarter cut-away side-views showing some components of a system for targeted control of downhole flow control devices, according to some embodiments. In FIG. 2A, packer devices 210 and 212 can be mechanical, hydraulic, hydrostatic or swell packers, and are set across a segment in the wellbore. Note that the wellbore can be a cased hole perforated or open hole wellbore. The packers 210 and 212 provide effective hydraulic isolation between segment 214 and other producing segments, such as neighboring segment 216.

Inflow Control Devices (ICD) 220 and 222 can be either choke based, or in conjunction with a spring allowing for a range of activation. Each ICD device provides the necessary choking of the fluid flow to restrict production into the wellbore from the formation or injection out of a wellbore into the formation. In FIG. 2A, the ICD 220 restricts production into flow line 202 from segment 214, and ICD 222 restricts production into flow line 202 from segment 216. Each ICD includes one or more chokes, which control the flow through the ICD. This choke may be of variable or fixed nature. The variable choke design is likely to be controlled by spring mechanical or hydraulic forces against a piston exposed to the upstream fluid. In the case of FIGS. 2A-B, choke orifices such as 224*a*, 224*b* and 224*c* are spaced apart around the circumference of the ICD 220. Choke sleeve 226 of ICD 220 is a sleeve that shifts over the chokes when activated and either closes off or restricts the fluids flow through the ICD.

Chemical tracers 228 and 230 are provided for isolated segments 214 and 216 respectively. The tracer technology is existing, and is a water or gas soluble chemical, which has a specific chemistry (sometimes referred to as a "DNA chemical tracer" even though real DNA is not identified). Tracers such as 228 and 230 are placed at different positions in the wellbore completion. Each position has a different, unique tracer chemical. Once the unwanted fluid passes into the wellbore, the tracer in that segment of the wellbore only is dissolved and the chemicals can be detected and analyzed at surface. This will tell the operator which section of the wellbore the water or gas is coming from.

A mechanical stop device is built into each ICD and acts as a stopper for a piston or other moving part. In FIG. 2B, stop device 244 of ICD is a ring of material that acts as a stopper for choke sleeve 226 which is urged towards the left by a coiled spring 240. The mechanical stop device 244 is retained in place or made of a chemical that is designed to change its state when contacted with a "trigger" chemical or catalyst. Once triggered this stop device will either dissolve, react, create pressure or temperature, or expand to allow a mechanical device (a piston or other such device) to move to a position where it either shuts in the choke, or restricts the size of the choke. In the case of FIGS. 2A-C, stop device 244 dissolves so that it no longer retains the choke sleeve 226 from moving to shut off the choke orifices.

A chemical trigger is a specific chemical designed to be pumped downhole and will react only with the targeted mechanical stop device as described above. The trigger may be an acid, a solvent, a catalyst or other chemical designed which is able to withstand the pumping operation to place it in the wellbore or the wellbore conditions, and also avoids damaging the formation. Ideally this chemical should be limited in volume to reduce unnecessary pumping or placement issues. In FIG. 2C, the trigger chemical that is specific to the stop device 244 has dissolved the stop device and as a result the choke sleeve 226 is urged to the left by coil spring 240 and covers the choke orifices such as orifices 224*a*, 224*b* and 224*c*.

There are numerous examples of chemicals that could provide the described "selective triggering" functionality. FIG. 12 is a table that presents selected examples chemicals that can be used to provide selective triggering, according to some embodiments. Table 1 lists several examples of "Base material"—which could be used in solid form—along with an example "trigger solvent" either non-polar, aprotic or polar protic. Table 1 provides examples of which base materials are best suited for deployment for selective triggering in a downhole completion environment. The following abbreviations are used for Table 1:

Y Base material is soluble in the solvent
PY Partially soluble in the solvent
N Base material is insoluble in the solvent
HT High Temperature Polymers
PS polystyrene
PE polyethylene
HDPE High density polyethylene
LDPE Low density polyethylene
PVC polyvinyl chloride
PET Polyethylene terephthalates
PC Polycarbonate
PVDF Polyvinylidene Fluoride Solvents
THF Tetrahydrofuran
DMF Dimethylformamide
DMAC Dimethylacetamide
TCB 1,2,4-trichlorobenzene
ODCB orthodichlorobenzene
DEE Diethyl ether
C-hexane Cyclohexane
DCM Dichloromethane
DMF Dimethylformamide
m-Cresol 3-methylphenol DMSO Dimethyl sulfoxide HCl Hydrochloric acid $HNO_3$ Nitric acid The examples listed in Table 1 is not an exhaustive list, but rather are examples to provide a basis for one skilled in the art to select specific chemical "pairs" allowing this selectivity in triggering them to a different state. For example, one could use solid piece of carbonate rock as a stop device. This piece of carbonate can be dissolved by many kinds of inorganic and organic acids; such as HCl, $H_2SO_4$, $HNO_3$, $CH_3COOH$, HCOOH etc. Other alternatives include the use of a piece of solid polystyrene which can be dissolved by acetone. A further examples is to utilise a piece of solid polyvinyl chloride (PVC) which can be dissolved by tetrahydrofuran.

Figure 3A:
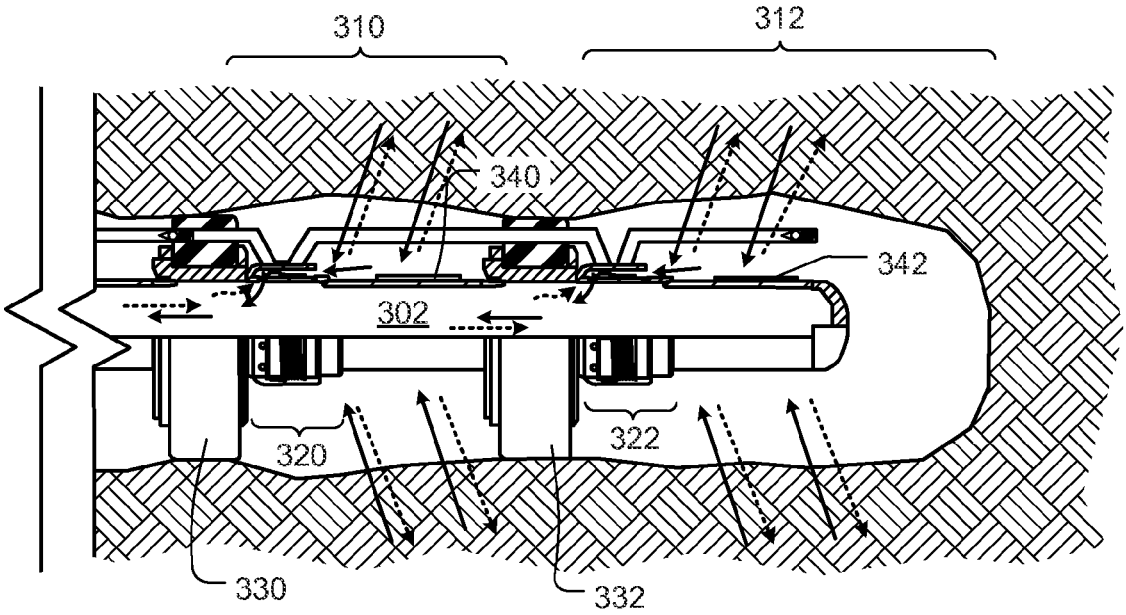
FIGS. 3A-E illustrate the principle of activation for a control line system, according to some embodiments.

FIGS. 3A-E illustrate the principle of activation for a control line system, according to some embodiments. Two zones 310 and 312 are illustrated to show the principle when water or other unwanted production fluid enters the production stream. In these examples it is assumed that oil is the production fluid, and water is the fluid to be controlled. Packers 330 and 332 are used to hydraulically isolate the zones 310 and 312. Fluid from zone 310 enters the flow line 302 via ICD 320 and fluid from zone 312 enters via ICD 322. In FIG. 3A, both zones 310 and 312 are producing oil, as shown by the solid arrows, through inflow control devices to balance or passively control production inflow. In FIG. 3A, all zones are producing into the wellbore.

Figure 3B:
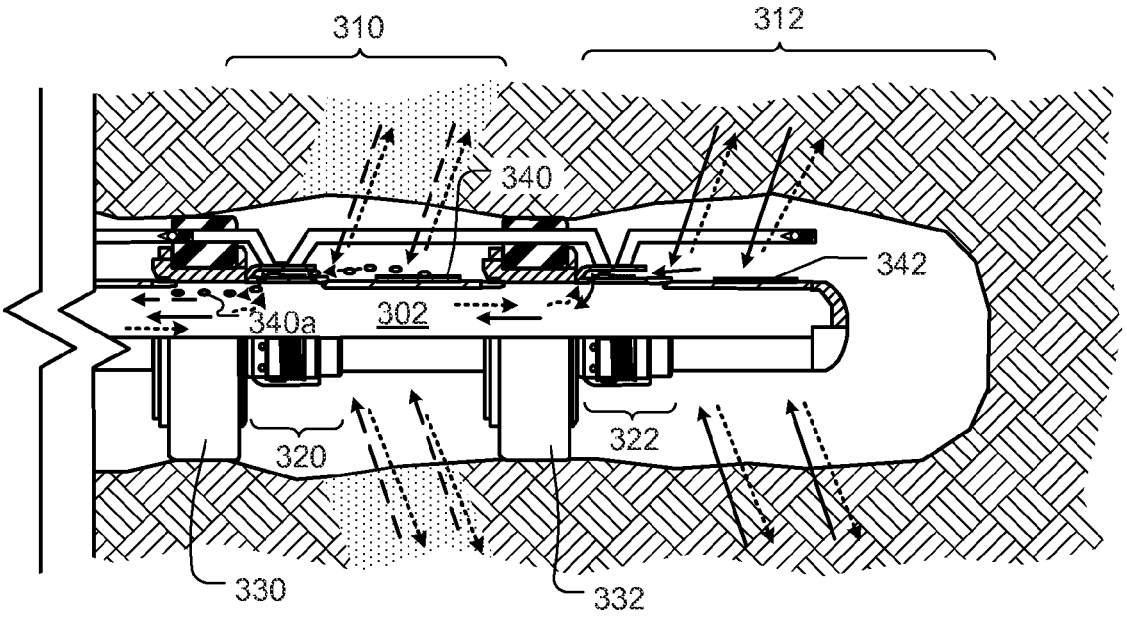

In FIG. 3B, zone 310 is producing water, as denoted by the broken-line arrows. Tracers 340 and 342 are soluble to water, since water is the undesirable fluid in this example. Tracer 340 therefore dissolves in water and enters the production stream as denoted by droplets 340*a*. Sampling of the fluids is done at surface to determine which tracer is being produced and therefore identifying that zone 310 is the water source.

Figure 3C:
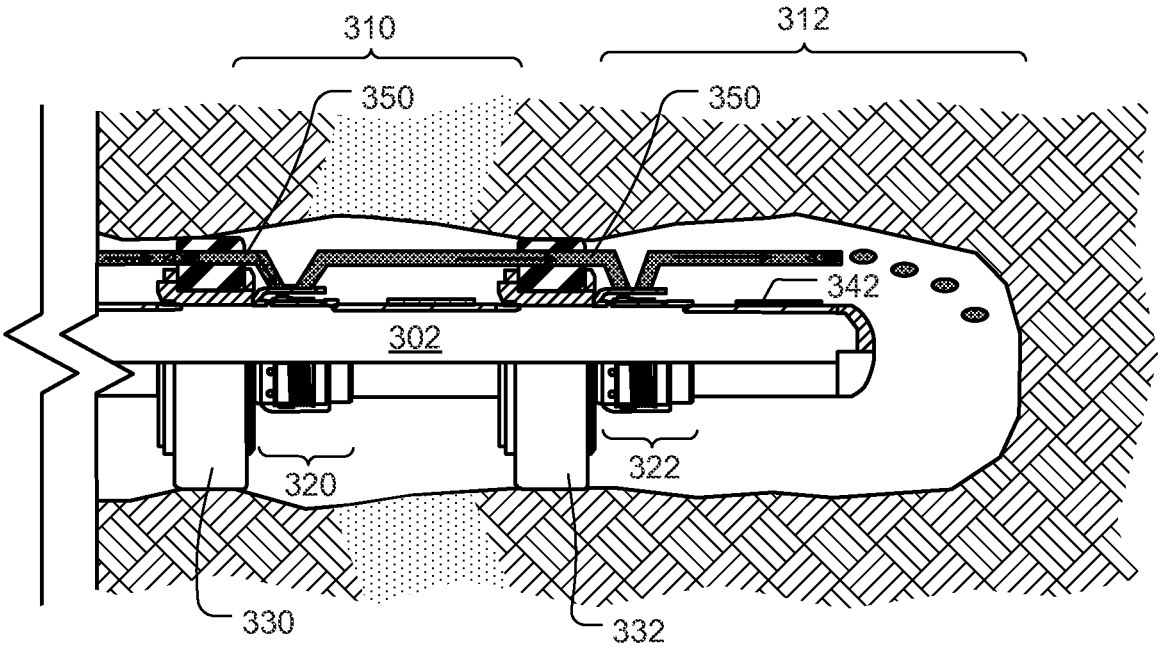
Figure 3D:
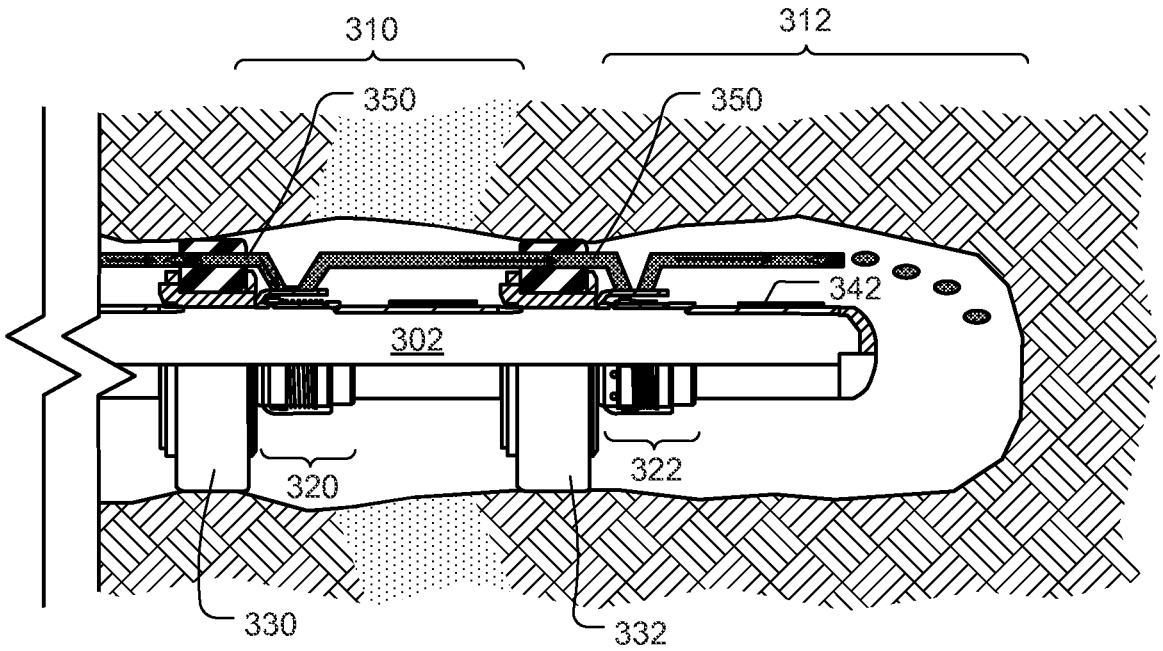
Figure 3E:
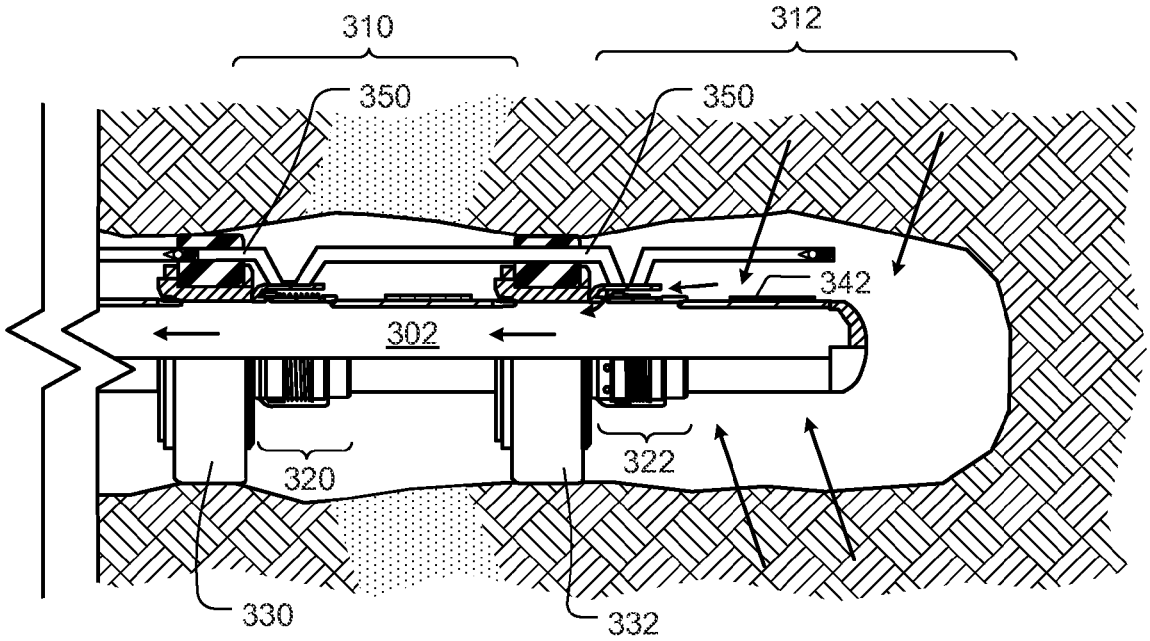

In FIG. 3C, a trigger chemical is selected to activate ICD 320 in zone 310 only. This chemical will not affect the ICD 322 in zone 312 or ICD's located other zones. Trigger chemical can be spotted by bullheading, manipulation of control valves or spotting via coiled tubing and pumped through the control line bypassing the segment packer and supplies the chemical directly to the inflow control devices. In the case of FIGS. 3A-E, a control line 350 is used that bypasses the packers. In FIG. 3D the trigger chemical reacts with a specific chemical in ICD 320 and allows ICD 320 to activate. This could be for example, by dissolving a mechanical stop device, as shown in and described with respect to FIGS. 2A-C. ICD 320 activates to close off flow port in ICD 320. Zone 310 is now isolated, while zone 312 is still able to produce. In FIG. 3E, the well is put back on production. Zone 310 is isolated, and zone 312 is still able to produce through inflow control device 322. The well now produces with lower water cut until such time as water encroaches wellbore at different position in reservoir.

Figure 4A:
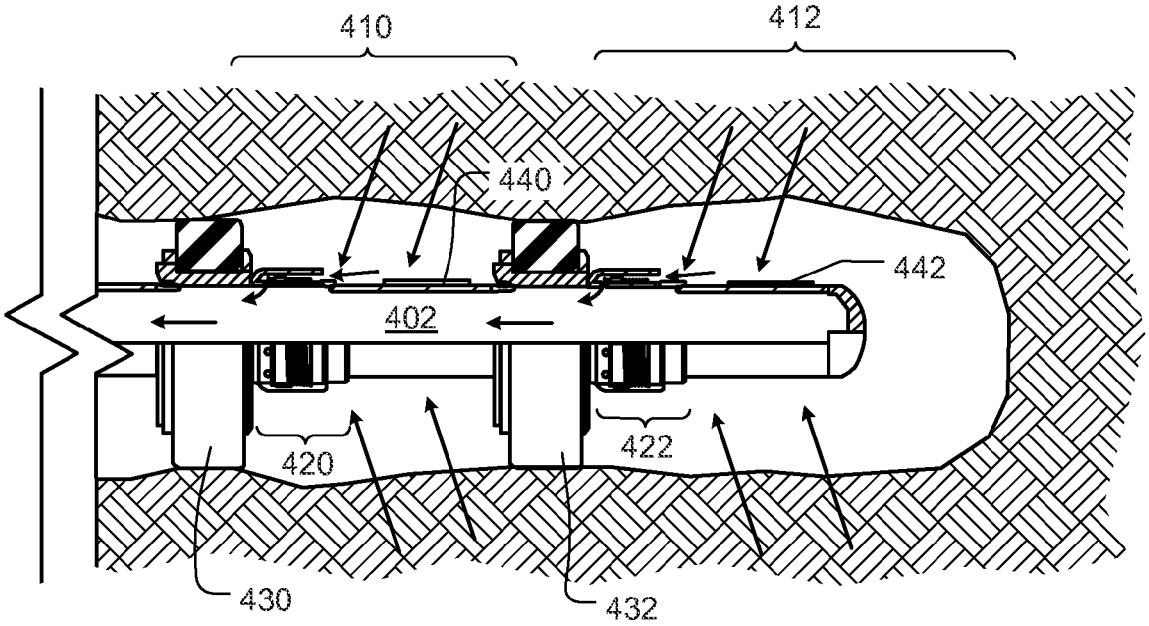
FIGS. 4A-E illustrate the principle of activation for a tubing bullhead based system, according to some embodiments.

FIGS. 4A-E illustrate the principle of activation for a tubing bullhead based system, according to some embodiments. Although simpler to deploy mechanically than a control line system as shown in FIGS. 3A-E, the option shown in FIGS. 4A-E use more chemicals and fluids for triggering, and potentially result in more fluids being bullheaded into the formation. Care should be taken with this option to ensure the fluid reaches all segments. If any segment allows too much fluid into it, it is possible that the chemical trigger will not reach segments further down the wellbore or lateral and therefore not activating the appropriate segment isolation mechanism. Two zones 410 and 412 are illustrated to show the principle when water or other unwanted production fluid enters the production stream. Packers 430 and 432 are used to hydraulically isolate the zones 410 and 412. Fluid from zone 410 enters the flow line 402 via ICD 420 and fluid from zone 412 enters via ICD 422. In FIG. 4A, both zones 410 and 412 are producing oil, as shown by the solid arrows, through inflow control devices to balance or passively control production inflow. In FIG. 4A, all zones are producing into the wellbore.

Figure 4B:
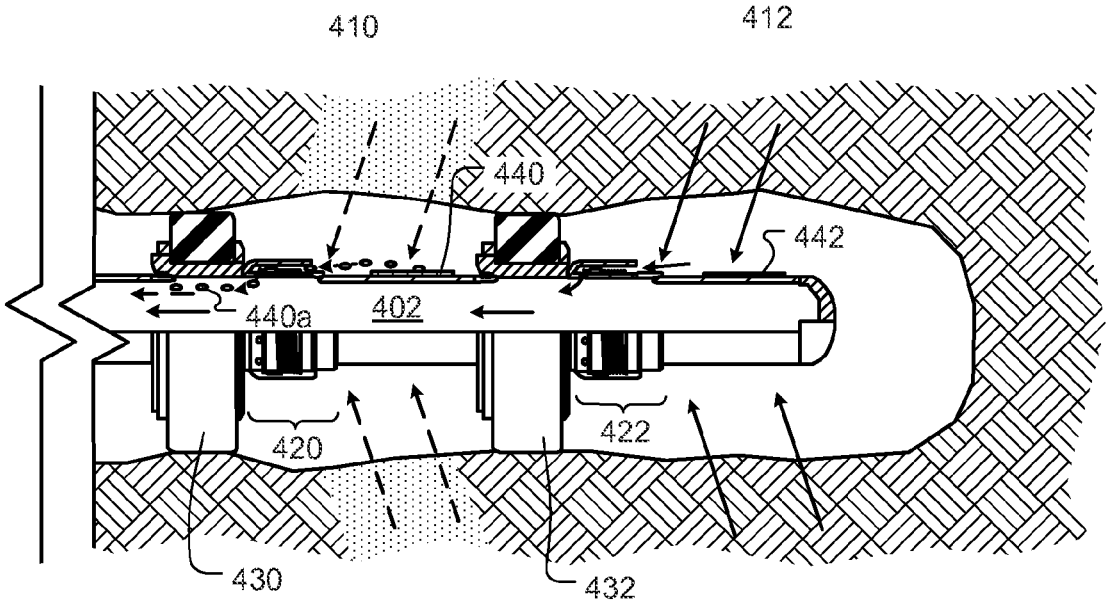

In FIG. 4B, zone 410 is producing water, as denoted by the broken-line arrows. Tracers 440 and 442 are soluble to water, since water is the undesirable fluid in this example. Tracer 440 therefore dissolves in water and enters the production stream as denoted by droplets 440*a*. Sampling of the fluids is done at surface to determine which tracer is being produced and therefore identifying that zone 410 is the water source.

Figure 4C:
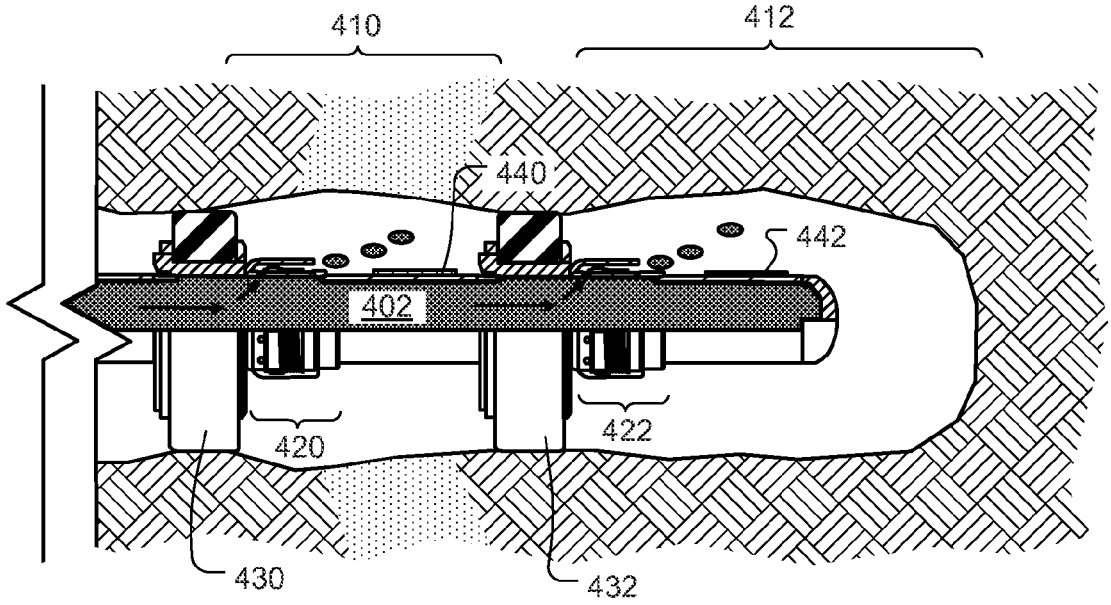
Figure 4D:
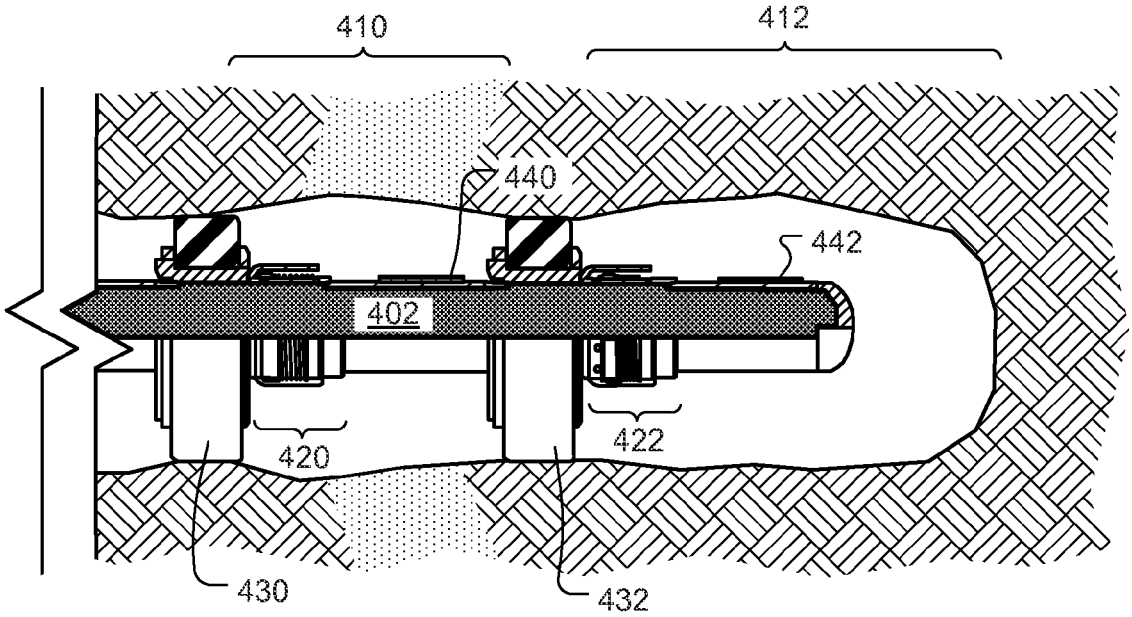
Figure 4E:
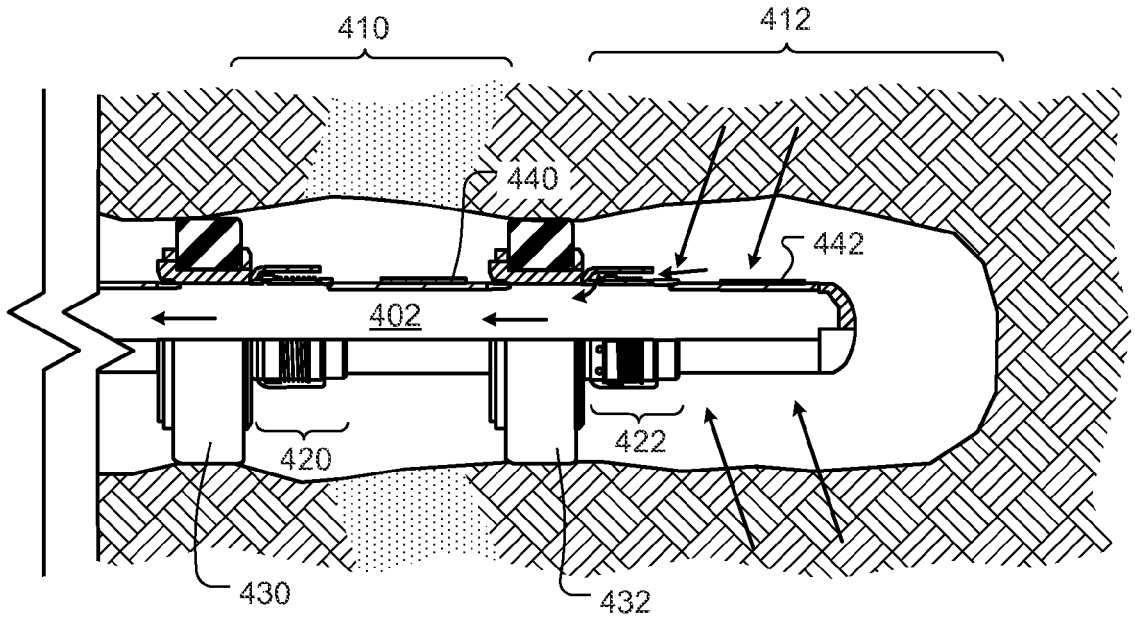

In FIG. 4C, a chemical trigger is selected to activate ICD 420 in zone 410 only. This chemical will not affect the ICD 422 in zone 412 or ICD's located other zones. The trigger chemical is spotted by bullheading, manipulation of control valves or spotting via coiled tubing and pumped through the tubing and bullheads through the inflow control devices. In FIG. 4D the trigger chemical reacts with a specific chemical in ICD 420 and allows ICD 420 to activate. This could be for example, by dissolving a mechanical stop device, as shown in and described with respect to FIGS. 2A-C. ICD 420 activates to close off flow port in ICD 420. Zone 410 is now isolated, while zone 412 is still able to produce. In FIG. 4E, the well is put back on production. Zone 410 is isolated, and zone 412 is still able to produce through inflow control device 422. The well now produces with lower water cut until such time as water encroaches wellbore at different position in reservoir.

Further detail regarding various activation and operating options will now be provided, according to some embodiments. Many options exist for the activation and chemical—mechanical mechanism to isolate the production.

Acid Soluble Cap/Stopper.

According to some embodiments, the mechanical stop shown in FIGS. 2B-C is an example where an acid soluble material such as carbonate rock can be used as a cap or stopper of a spring loaded valve. The valve is set to be normally open when the cap is in place by compressing the spring. An acid can be injected when desired to dissolve the cap/stopper and release the spring such that the valve will be in a closed position.

Acid Soluble Material in Chamber.

Figure 5A:
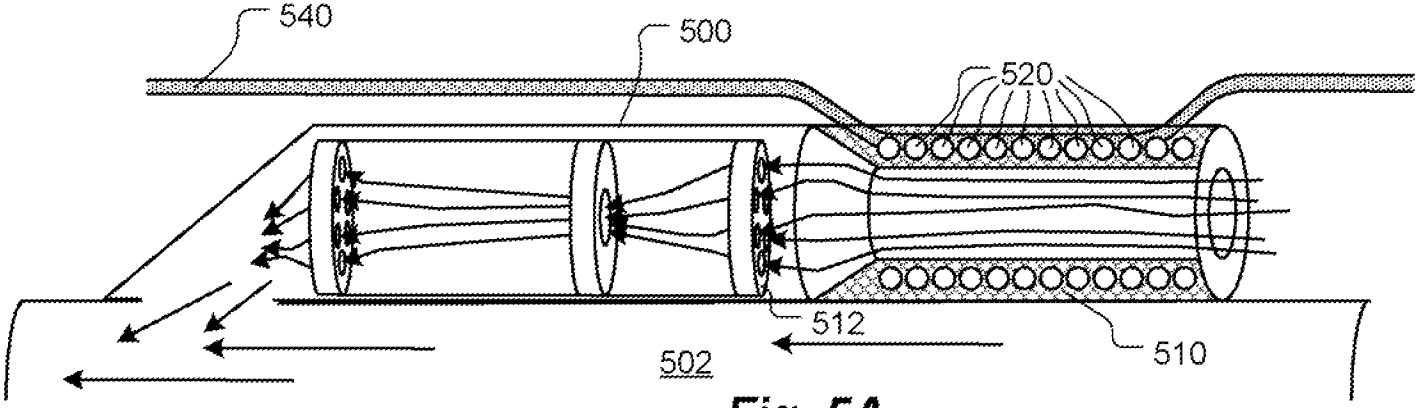
FIGS. 5A-B illustrate a flow control device having releasable sealing balls, according to some embodiments.
Figure 5B:
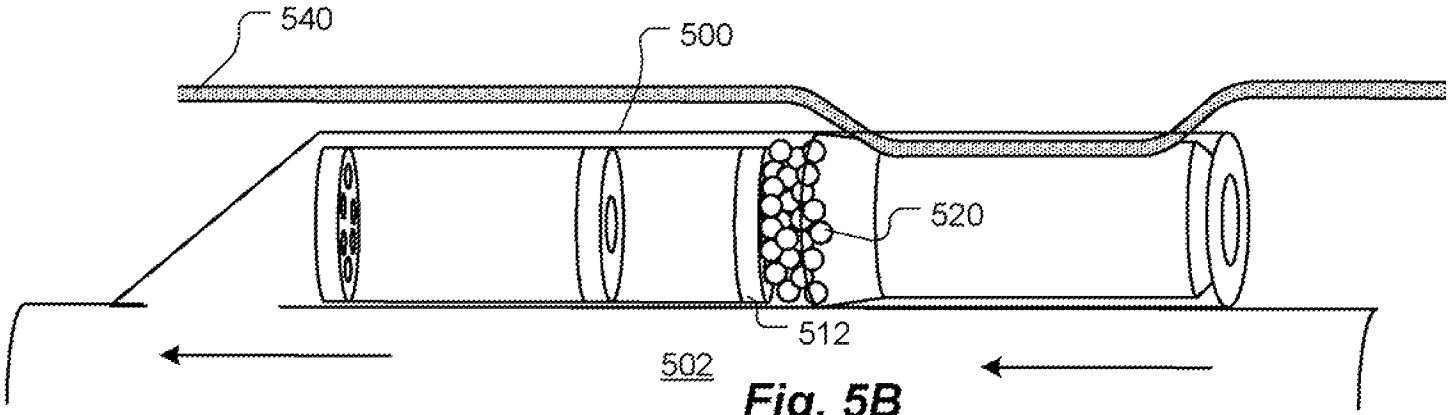

FIGS. 5A-B illustrate a flow control device having releasable sealing balls, according to some embodiments. Flow control device 500 has a cylindrical body through which fluid produced from the production zone can flow into a production tubing 502. The produced fluid flows through an orifice plate 512 that includes a number of uniformly sized orifices. Flow control device 500 is installed into a well section, and includes an annular chamber 510 that is made of an acid soluble material such as carbonate rock. The chamber 510 contains pre-sized balls 520 that can be released to plug the orifices in plate 512 of the flow control device 500. According to some embodiments a control line 540 is used to direct the triggering chemical directly to the chamber 510. According to other embodiments, the triggering chemical can be bullheaded as described with respect to FIGS. 4A-E. According to some embodiments, the release of the balls 520 is done by injecting an acid that dissolves the chamber. According to other embodiments, other materials can be used for the construction of the chamber including plastic, organic and inorganic compounds that can be dissolved by specific fluids. In FIG. 12, Table 1 gives a number of alternative options of chemicals that could be deployed for such a purpose. Examples include a chamber made in aluminium and dissolved by acid such as HCl. Polyvinyl chloride chamber is resistant to HCl, but can be dissolved by Tetrahydrofuran solvent. Polyethylene terephthalate chamber is soluble in phenol, chlorophenol, nitrobenzene and dimethyl sulphoxide. It is insoluble in ether and in most other organic solvents.

FIG. 5B shows the flow control device 500 after the sealing balls have been released and are sealing the orifices on plate 512. According to some embodiments, chamber 510 can contain a material having a low melting point and the triggering chemical can be designed to cause an exothermic chemical reactions, as is discussed in further detail below.

Chamber Soluble to Specific Trigger Chemicals or Catalysts.

Figure 6A:
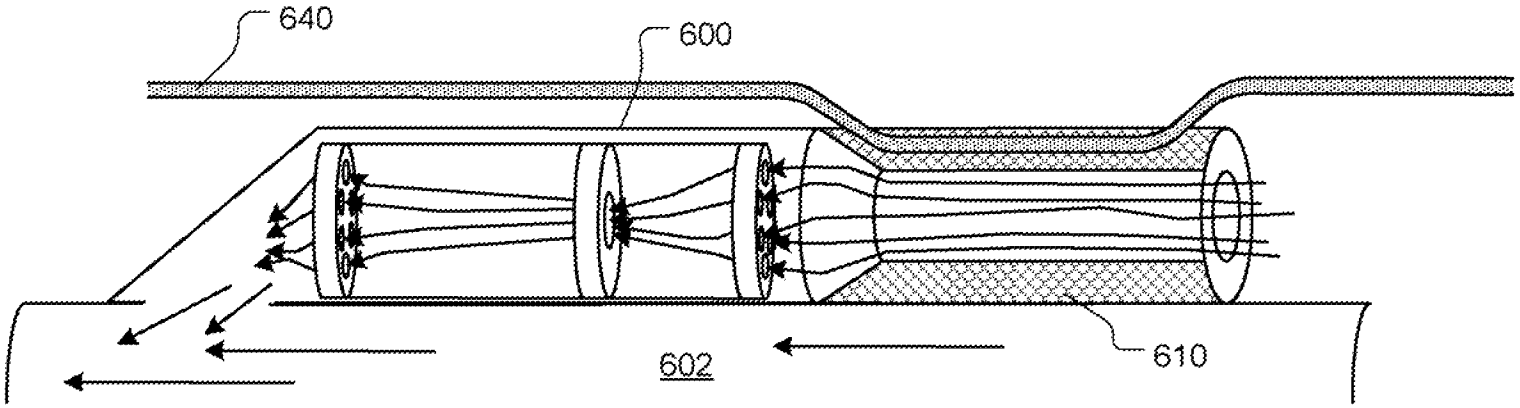
FIGS. 6A-B illustrate a flow control device having a chamber with a material that swells when in contact with a trigger chemical, according to some embodiments.
Figure 6B:
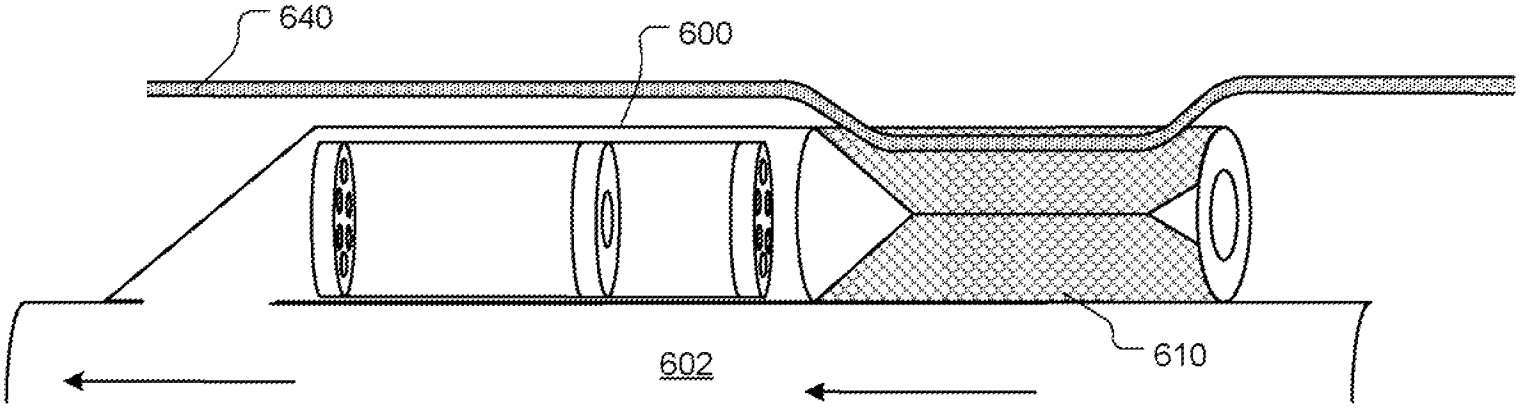

FIGS. 6A-B illustrate a flow control device having a chamber with a material that swells when in contact with a trigger chemical, according to some embodiments. Flow control device 600 has a cylindrical body through which fluid produced from the production zone can flow into a production tubing 602. The produced fluid flows through the center surrounded by an annular chamber or region 610 that contains a chemical or chemicals that will swell when reacting with a specific injection fluid. The triggering fluid can be directed to the chamber 610 via a control line 640 or it can be bullheaded as is described with respect to FIGS. 4A-E. As the material in the chamber 610 swells, it fills and seals the chamber such that the valve is effectively shut, as shown in FIG. 6B. The swelling of the material in the chamber 610 can be triggered by fluid adsorption, heat, or chemical reaction. According to some embodiments, the chamber can be made of material that can be dissolved by specific fluids such as acid. Referring to FIG. 12, Table 1 lists potential chemical pairs—base and trigger—that could be deployed for these examples.

Chamber with Material with Low Melting Point.

Similar to the embodiments described with respect to FIGS. 6A-B, according to some embodiments a resin, wax, or other materials with melting higher than the reservoir temperature in the chamber is used. An exothermic reaction can be created by the reaction between the injection fluid and the chamber to cause temperature increase beyond the melting of the filling materials in the chamber, such as resin. The melted material will fill the fluid flow path, and solidify when the exothermic reaction ceases, to plug off the flow ports or valves. The flow ports or valves can be unplugged when pumping heated fluid to melt the solidified material. According to some embodiments, the material melting can be used to release sealing balls or other particles, such as described with respect to FIGS. 5A-B. Table 1 of FIG. 12 lists potential chemical pairs—base and trigger—that could be deployed for these examples.

Single or Multiple Layer Catalysts.

According to some embodiments, a single layer or multiple layers of an encapsulated catalysts, are embedded in resin fluids which release after injecting certain solvents to dissolve the encapsulated layer. The released catalysts will allow resins to cure into a solid which can block a flowing channel. Thus, by using encapsulation, the number of uniquely "addressable" or individually targeted flow control devices or zones can be effectively increased, given a set number of chemical reactions. Table 1 in FIG. 12 lists potential chemical pairs—base and trigger—that could be deployed as encapsulated solids or fluids. After the encapsulation is destroyed due to contact with a trigger chemical, the chemical within is released and can perform the function herein. One example is Epoxy Resin, in order to convert epoxy resins into a hard material, it is necessary to cure the resin with hardener (catalyst). Epoxy resins cure quickly and easily at practically any temperature from 5-150° C. depending on the choice of hardener. The hardeners for epoxies include amines, polyamides, anhydrides, isocyanates, etc. For instance, anhydride can be encapsulated by polystyrene, and embedded in the epoxy resin. If it is desirable to release anhydride, acetone can be pumped to dissolve the encapsulated layer. The released anhydride will be dispersed into epoxy resin, and allowed to cure into a solid.

Exothermic Reactions.

Figure 7A:
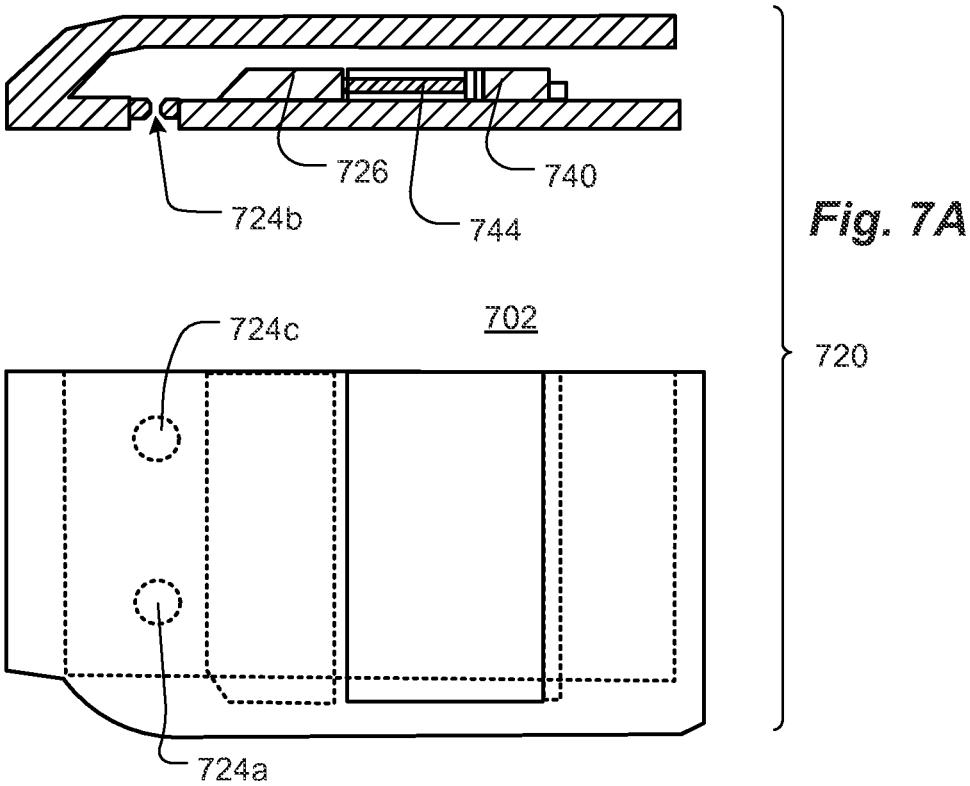
FIGS. 7A-B illustrate a flow control device having a choke sleeve controlled by an exothermic chemical reaction, according to some embodiments.
Figure 7B:
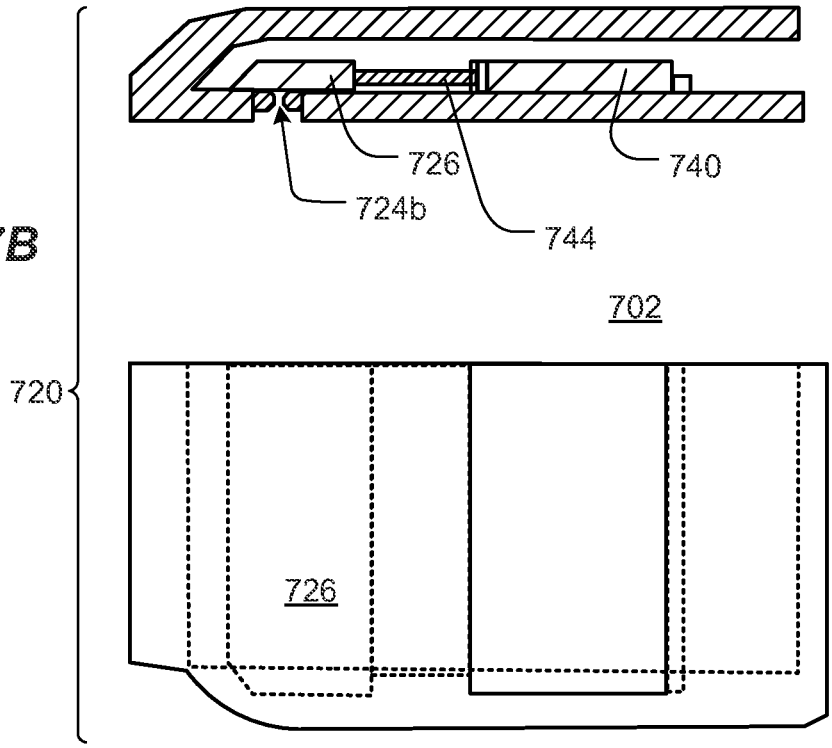

Exothermic chemical reactions can be used to significantly increase an initial internal volume in for example, an enclosed chamber. A valve can be coupled to the reaction chamber to shut down by the expansion. FIGS. 7A-B illustrate a flow control device having a choke sleeve controlled by an exothermic chemical reaction, according to some embodiments. ICD 720 includes a number of choke orifices such as orifices 724*a*, 724*b* and 724*c* trough which fluid from the formation can enter the production tubing 702. A choke sleeve 726 can slide over the orifices to shut off fluid flow, under the control of a triggering chemical. A piston 744 is actuated by an exothermic chemical reaction in chamber 740. The exothermic reaction causes the choke sleeve 726 to slide to the left so as to shut off fluid flow between the formation and tubing 702, as shown in FIG. 7B. Note that according to some embodiments, exothermic chemical reactions can be used to melt material for use in devices such as described with respect to FIGS. 6A-B and FIGS. 5A-B.

According to some embodiments the ICD 720 is a pneumatically operated valve, and the introduced triggering chemical causes a reaction to generate gas that actuates the pneumatic valve. Examples of gas generating reactions include acid (organic acids such as formic and acetic acid, or inorganic acids such as hydrochloric acid or nitric acid) reacting with sodium carbonate, sodium bicarbonate, or calcium carbonate; sodium nitride ($NaNO_2$) reacting with sulfamic acid ($HSO_3NH_2$).

Mixed Base-Gel Fluid.

According to some embodiments, a flow control device can be combined with a chamber that contains mixed base-gel fluid, such as a guar-gel system or surfactants. After injecting typically a metallic salt-crosslinker, a highly viscous material is created to block the flow channels. This system is also reversible. This high viscosity gel will be degradable by injecting oxidizers. In other words, the closed channels can be re-opened.

Further detail will now be provided for system architectures associated with chemically targeted control of flow control devices, according to some embodiments. Many options exist for incorporation of the techniques described herein into a completion, from simple to highly complex integrated completions.

FIGS. 8A-E are diagrams representing a basic horizontal well system using chemically targeted flow control devices, according to some embodiments. The upper completion 810 is illustrated as a simple tubing plus production packer, but could be any upper completion, either run separately or in conjunction with the lower completion.

Figures 8A, 8B:
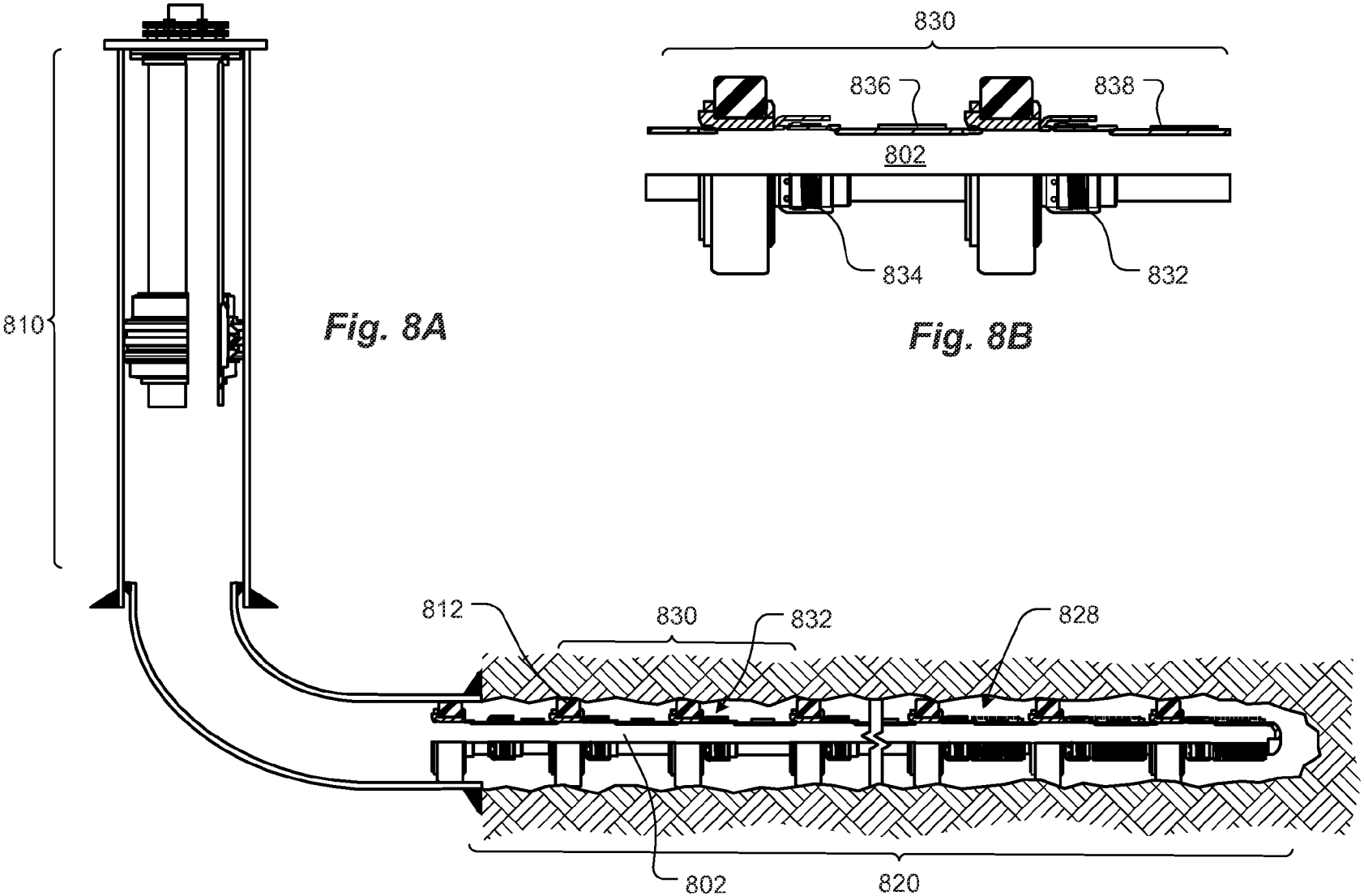
FIGS. 8A-E are diagrams representing a basic horizontal well system using chemically targeted flow control devices, according to some embodiments.
Figures 8C, 8D, 8E:
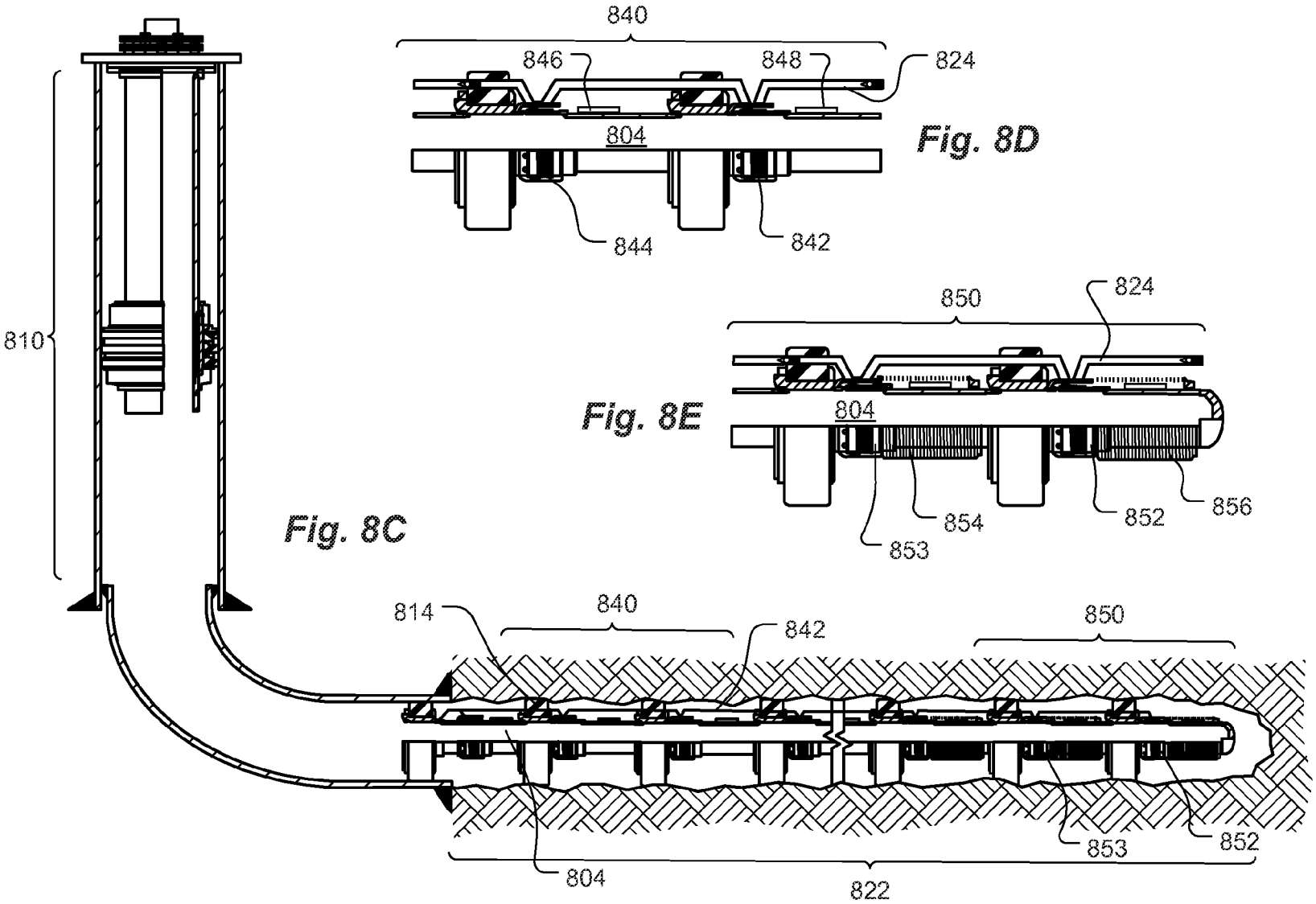

The lower completions 820 and 822 are shown in FIGS. 8A and 8C respectively, and share a number of components in common. FIG. 8B show detail for region 830 in completion 820, while FIGS. 8D and 8E show detail for regions 840 and 850 respectively in completion 822. Isolation packers such as 812 and 814 are used to hydraulically isolate adjacent segments. Note that the lower completions 820 and 822 can be open hole or cased hole. For each isolated segment, an inflow control device (ICD) is provided such as ICDs 832, 834 and 828 in FIGS. 8A and 8B, and ICDs 842, 844, 852 and 853 in FIGS. 8C, 8D and 8E. The inflow control devices each contain a mechanism to close or significantly reduce the flow area when triggered with a "trigger chemical" as described herein. Sand screens such as screens 854 and 856 in FIG. 8E are optionally provided, for example in completions requiring sand control, in conjunction with the system architectures shown. A flowing fluid "detector"—a tracer chemical placed in each isolated segment completion device that is soluble in a specific target fluid phase (e.g. water or gas), for example, tracer chemicals 836 and 838 are shown in FIG. 8B, and tracer chemicals 846 and 848 are shown in FIG. 8D. Once that fluid phase starts to produce into the wellbore, the tracer will slowly dissolve into the production stream and be detected at surface by chemical analyses.

In the case of completion 820 shown in FIG. 8A, the "trigger chemical" or catalyst is pumped downhole by bullheading through the completion tubing 802 to all the inflow control devices in the lateral section. The pumped chemical preferably contacts each and every one of the inflow control devices in order to activate the target device. As such it is expected that larger fluid volumes would be used. In addition, this option would obviate or make more complicated the use of check valves in each of the inflow control devices.

FIG. 8C highlights an alternative and more economical system option, according to some embodiments, whereby the trigger chemical is bullheaded from surface or spotted just above the lower completion via coiled tubing. Once the triggering chemical reaches the upper segment the chemical being pumped will bypass through the control line 842 which passes each and everyone of the inflow control valves. The trigger chemical or catalyst thus passes each of the valves. Only the target valve is activated by the pre-determined chemical reaction. The option shown in FIG. 8C reduces the amount of trigger chemical required reducing potential formation damage making it more efficient, and allows the inflow control valves to contain a flow check mechanism eliminating wellbore cross-flow.

Figure 9:
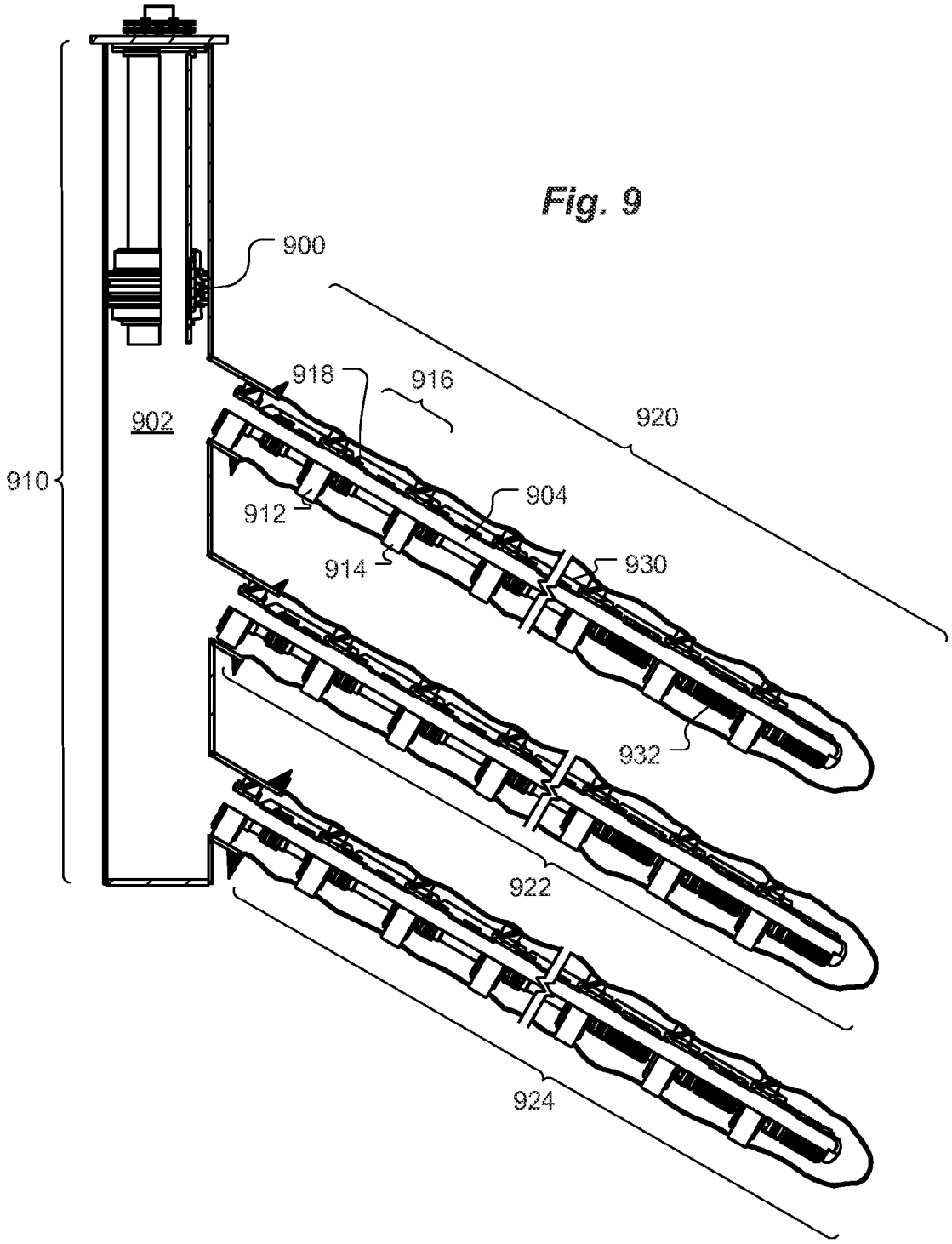
FIG. 9 illustrates using chemically targeted flow control devices in a multi-lateral application with a non-intelligent motherbore completion according to some embodiments.
Figure 10:
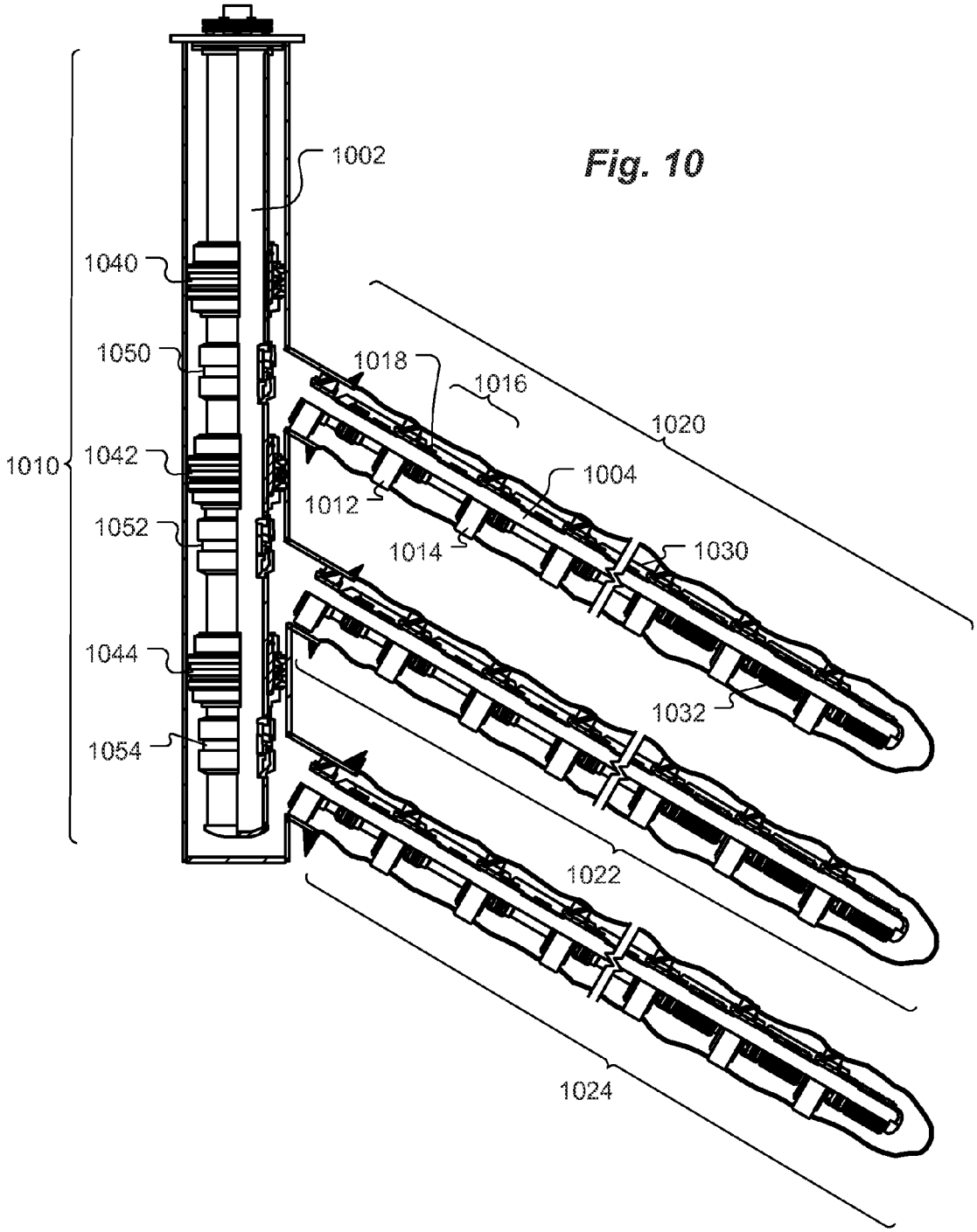
FIG. 10 illustrates using chemically targeted flow control devices in a multi-lateral application with an intelligent motherbore completion, according to some embodiments.
Figure 11:
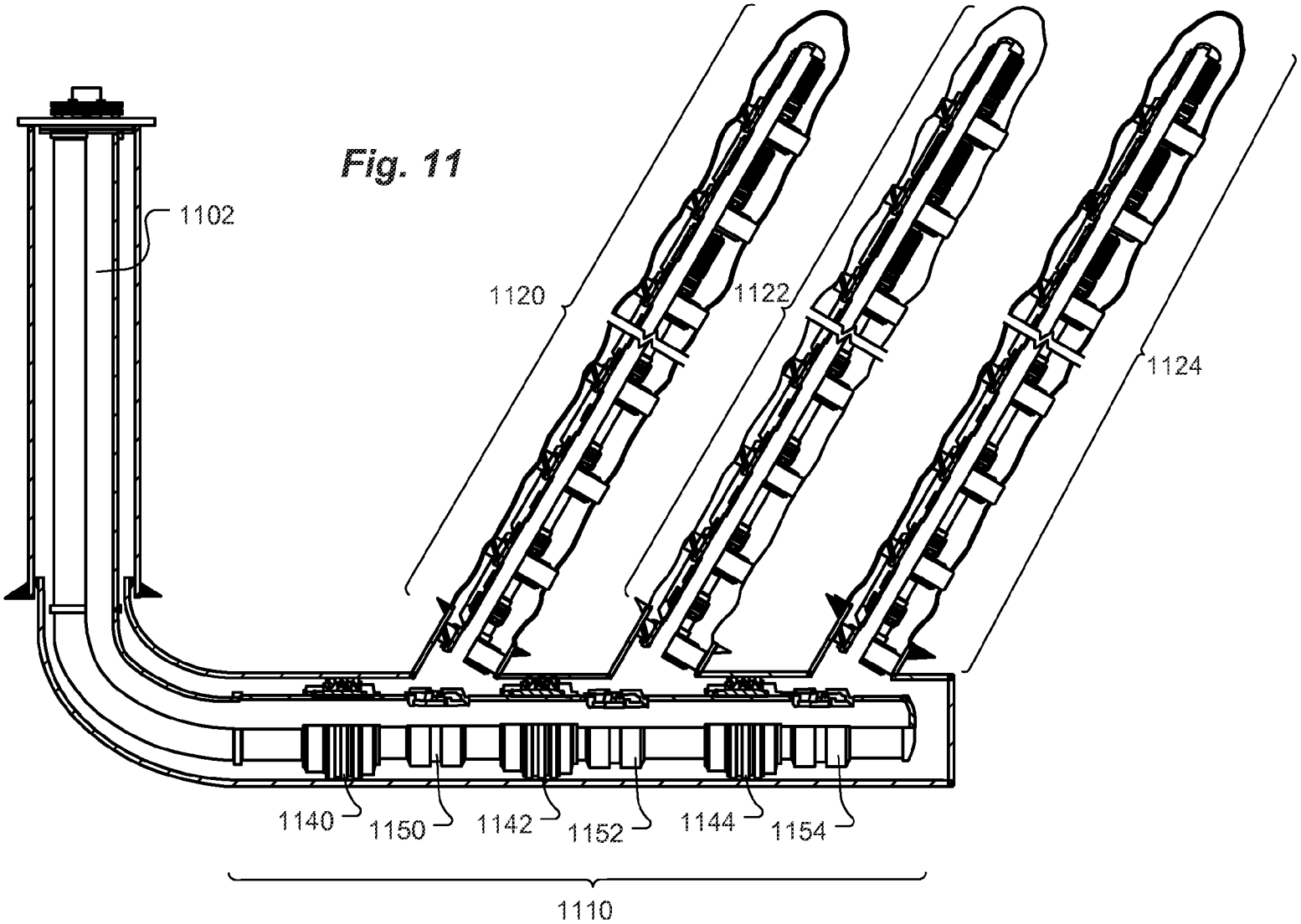
FIG. 11 illustrates using chemically targeted flow control devices in a multi-lateral application with a horizontal motherbore, according to some embodiments.

FIGS. 9-11 illustrate multilateral completions using chemically targeted flow control devices, according to some embodiments. A significant advantage of utilizing chemical catalysts or "triggers" to activate a mechanical or hydraulic device, such as the inflow control devices described herein, is that it can be spotted and pumped easily into complex wellbores, such as multi-laterals. Intelligent completions in the motherbore (see FIGS. 10 and 11) can be combined with chemically activated lateral sections to allow a flexible, yet relatively simple design in getting fluid sensitivity and a measurement of segmented control into difficult to intervene lateral sections.

A chemically activated multilateral completion can also be designed without a need for intelligent completion components, for example as in FIG. 9, which illustrates using chemically targeted flow control devices in a multi-lateral application with a non-intelligent motherbore completion according to some embodiments. In certain circumstances, where chemical triggers can be spotted at the appropriate lateral junction by coiled tubing or bullheading from surface to all lateral legs at the same time. In FIG. 9, the motherbore 910 is completed with a single packer 900. Multiple lateral wellbores branch off of motherbore 910 of which three are shown 920, 922 and 924. Each lateral can be completed with casing, or openhole, as shown, as a perforated cased lateral, or as a combination of the two. Each lateral includes a number of packers that are used to hydraulically isolate production zones within the subterranean formation. Each isolated zone preferably includes a flow control device having both a chemical tracer and chemically triggered control of the flow, using one or more of the techniques described herein. For example, in lateral 920, packers 912 and 914 are used to isolate a zone 916 of the formation for production into tubing 904. The flow of fluid from the formation zone 916 into the tubing 904 is controlled using a flow control device 918 which preferably includes a chemical tracer sensitive to unwanted fluid, and a chemically activated shut-off means such as described herein. The triggering chemical can be delivered using a control line 930 as shown, or it can be delivered through the production tubing 904. Some or all of the flow control devices can also be equipped with sand screens such as shown with flow control device 932.

FIG. 10 illustrates using chemically targeted flow control devices in a multi-lateral application with an intelligent motherbore completion, according to some embodiments. The motherbore 1010 has an intelligent completion that includes packers 1040, 1042 and 1044 which hydraulically isolate inflow from laterals 1020, 1022 and 1024. The flow from each lateral is controlled using inflow control valves 1050, 1052 and 1054. Alternatively, sliding sleeves can be used instead of the valves. The intelligent completion in motherbore 1002 allows for control and monitoring of individual lateral contributions. Each lateral 1020, 1022 and 1024 can be completed with casing, or openhole, as shown, as a perforated cased lateral, or as a combination of the two. Each lateral includes a number of packers that are used to hydraulically isolate production zones within the subterranean formation. Each isolated zone preferably includes a flow control device having both a chemical tracer and chemically triggered control of the flow, using one or more of the techniques described herein. For example, in lateral 1020, packers 1012 and 1014 are used to isolate a zone 1016 of the formation for production into tubing 1004. The flow of fluid from the formation zone 1016 into the tubing 1004 is controlled using a flow control device 1018 which preferably includes a chemical tracer sensitive to unwanted fluid, and a chemically activated shut-off means such as described herein. The triggering chemical can be delivered using a control line 1030 as shown, or it can be delivered through the production tubing 1004 as described herein. Some or all of the flow control devices can also be equipped with sand screens such as shown with flow control device 1032.

FIG. 11 illustrates using chemically targeted flow control devices in a multi-lateral application with a horizontal motherbore, according to some embodiments. The motherbore 1110 has an intelligent completion that includes packers 1140, 1142 and 1144 which hydraulically isolate inflow from laterals 1120, 1122 and 1124. The flow from each lateral is controlled using inflow control valves 1150, 1152 and 1154. Alternatively, sliding sleeves can be used instead of the valves. The intelligent completion in motherbore 1102 allows for control and monitoring of individual lateral contributions.

According to some embodiments, the structures, chemistry and techniques described herein are used for injection of fluids into the formation, instead of control of fluid flow from the formation. For example, injection devices can be used for fracturing or other stimulation procedures, which can be selectively activated by use of a chemical trigger mechanism. The embodiments of all of the foregoing figures can be adapted to operate in reverse—to selectively control injection of fluid into the formation. Specific examples of injection devices are shown in FIGS. 2A, 2B, 3A and 3B in which the injection flow is shown in dotted-line arrows. Another specific example of an injection flow control device is shown in FIG. 13.

Figure 13:
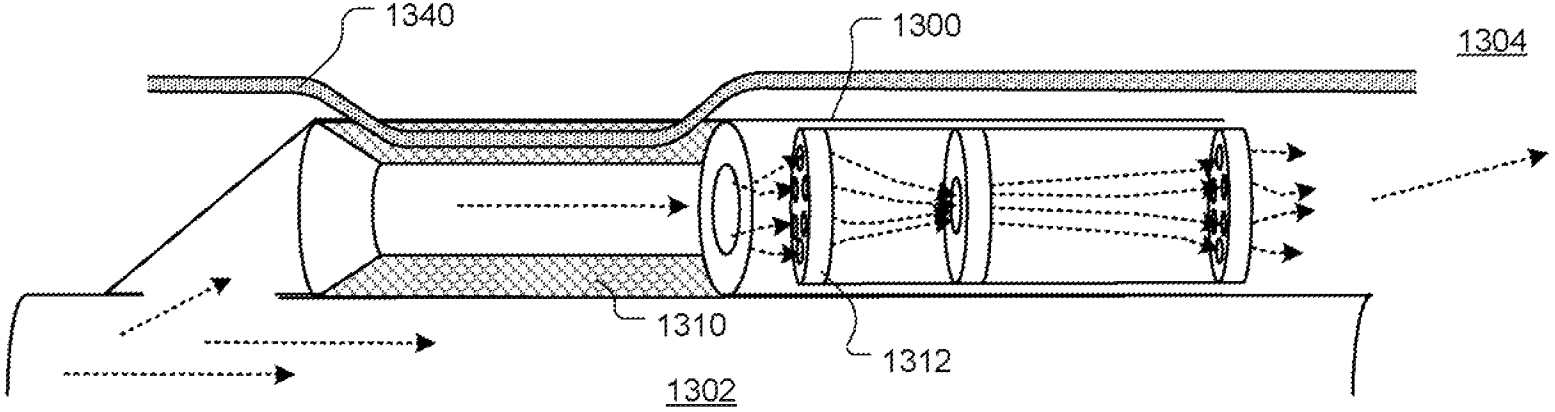
FIG. 13 illustrates an injection flow control device, according to some embodiments.

FIG. 13 illustrates an injection flow control device, according to some embodiments. Injection flow control device 1300 has a cylindrical body through which injection fluid can flow from tubing 1302 into a zone 1304 in the subterranean formation. The injection fluid flows through an orifice plate 1312 that includes a number of uniformly sized orifices. Flow control device 1300 includes an annular chamber 1310 that is made of acid soluble material such as carbonate rock is installed into a well section. According to some embodiments, chamber 1310 contains a chemical or chemicals that will swell when reacting with a specific injection fluid, such as shown in and described with respect to FIGS. 6A-B. According to some other embodiments, the chamber 1310 contains pre-sized sealing balls (not shown) that can be released to plug the orifices in plate 1312 of the flow control device 1300, such as shown in and described with respect to FIGS. 5A-B. According to some embodiments a control line 1340 is used to direct the triggering chemical directly to the chamber 1310. According to other embodiments, the triggering chemical can be bullheaded as described with respect to FIGS. 4A-E. According to some embodiments, the release of the sealing balls is done by injecting an acid that dissolves the chamber. According to other embodiments, other materials can be used for the construction of the chamber including plastic, organic and inorganic compounds that can be dissolved by specific fluids. In FIG. 12, Table 1 gives a number of alternative options of chemicals that could be deployed for such a purpose. According to some embodiments, a shrinkable material is used in chamber 1310 such that the injection flow control device 1300 is normally closed (analogous to chamber 610 shown in FIG. 6*b*), and the exposure to a triggering chemical causes the material in chamber 1310 to shrink and open such as shown FIG. 13.

According to some embodiments a combination of inflow control devices and injection flow control devices are deployed in a wellbore and can be selectively triggered using introduced chemicals according to the teachings provided herein.

Figure 14A:
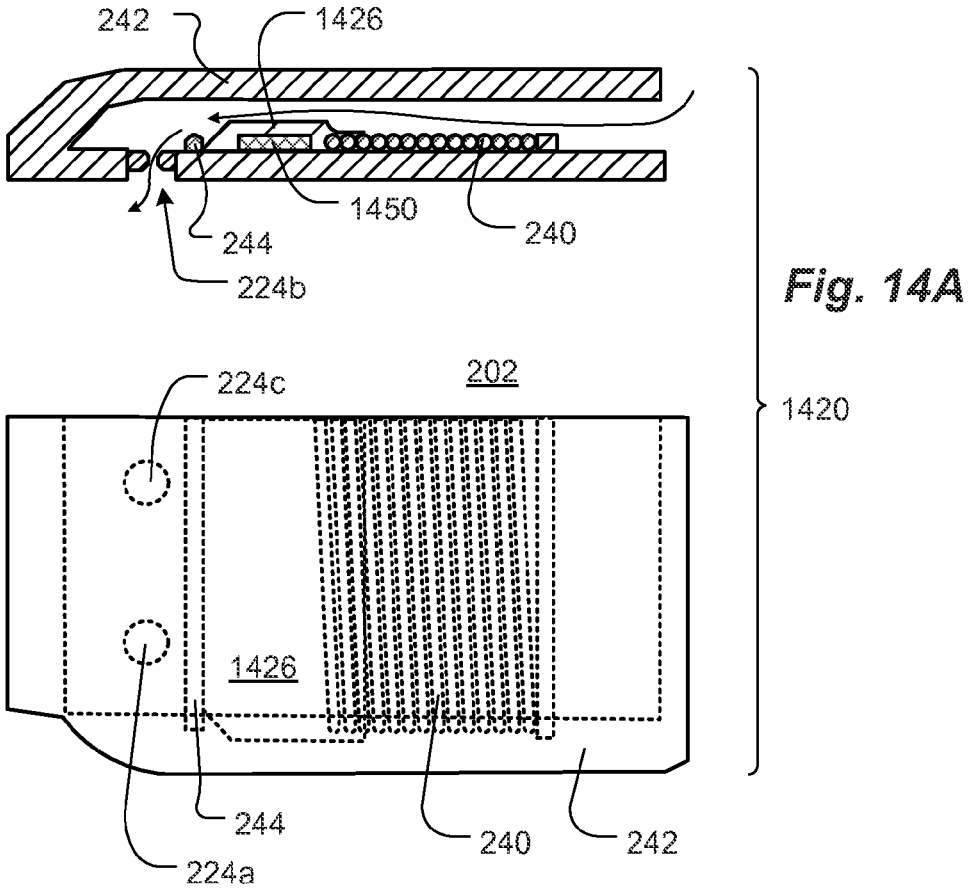
FIGS. 14A-B are quarter cut-away side-views showing some components of a downhole flow control device having an indicator chemical released to confirm device actuation, according to some embodiments.
Figure 14B:
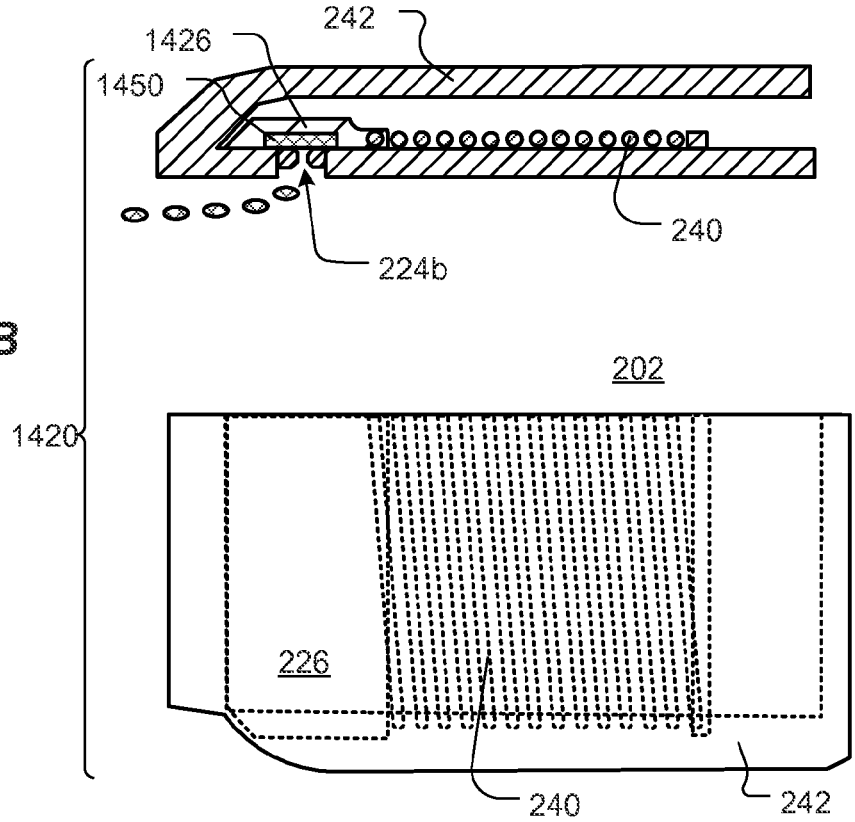

FIGS. 14A-B are quarter cut-away side-views showing some components of a downhole flow control device having an indicator chemical released to confirm device actuation, according to some embodiments. Flow control device 1420 is similar in most respects to inflow control device 220 as shown in FIGS. 2A-C, and can also operate in injection mode, according to some embodiments. The device 1420 can be actuated in the same fashion as described with respect to device 220 in FIGS. 2A-C, namely, a trigger chemical is used to dissolve or react with stop device 244 such that the stop no longer retains the choke sleeve 1426. The choke sleeve 1426 is urged to the left by coil spring 240 such that it covers the choke orifices 224*a*, 224*b* and 224*c*. However according to these embodiments a material containing a further chemical, "indicator chemical" 1450 is included in the choke sleeve. When the choke sleeve 1426 is in the closed position, as shown in FIG. 14B, the chemical 1450 mixes with the wellbore fluids flowing in flowline 202 and can be detected upstream by sampling the production stream. This chemical 1450 is considered an "indicator" a specific device has physically actuated downhole, thereby providing assurance to the operator that particular device has shifted (closed or open depending on configuration).

Figure 15A:
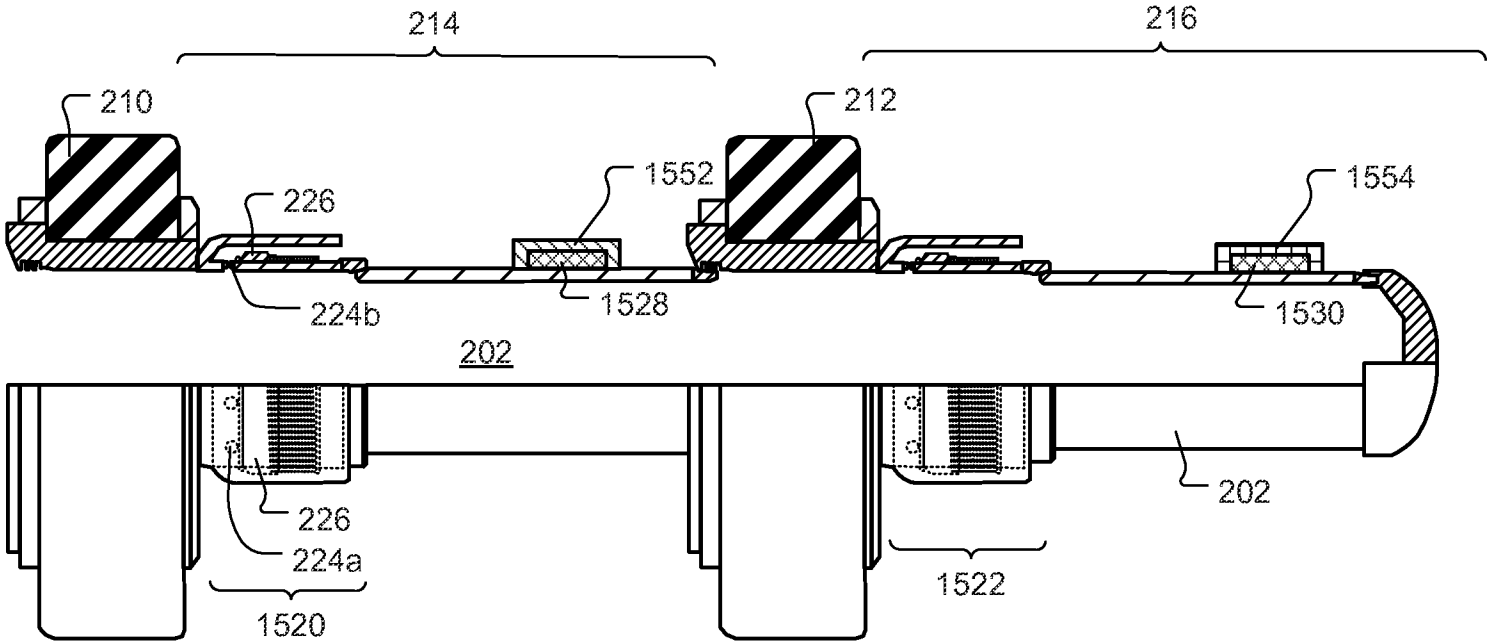
FIGS. 15A-B are quarter cut-away side-views showing some components of downhole flow control devices having self-triggering capability, according to some embodiments.
Figure 15B:
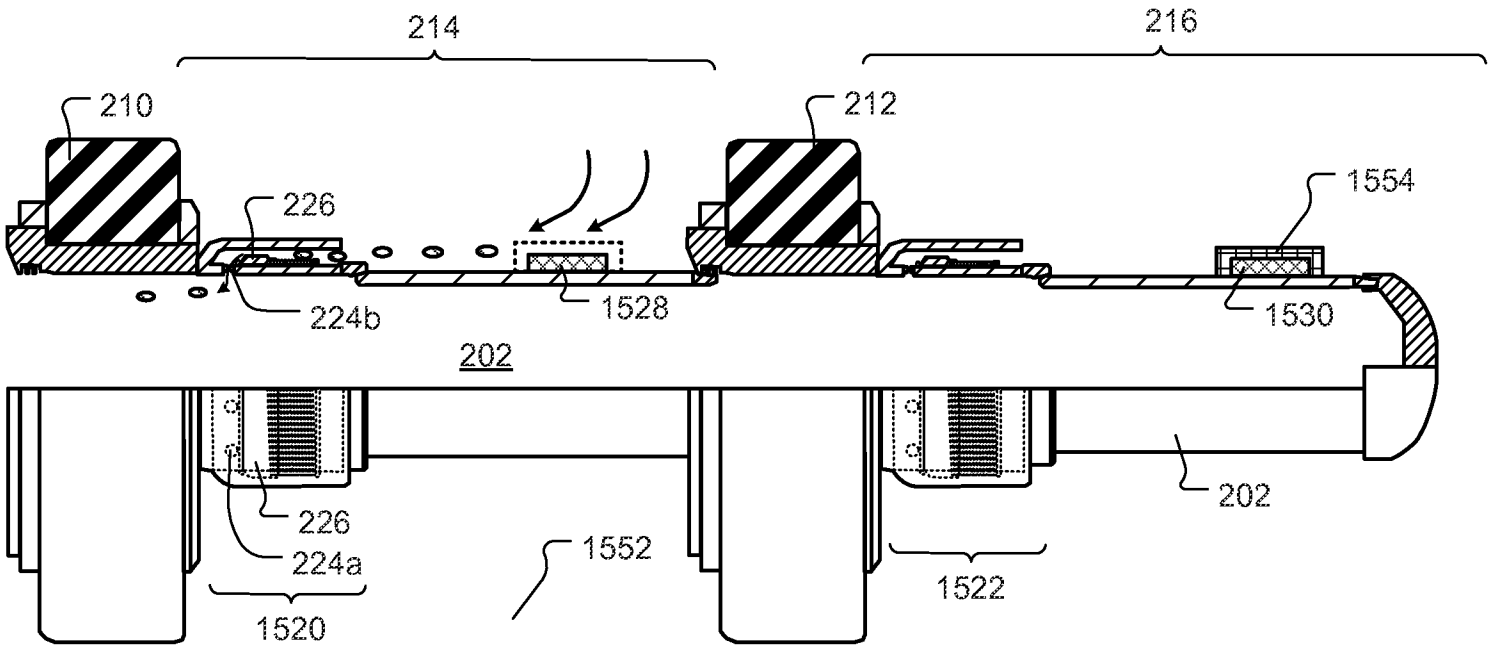

FIGS. 15A-B are quarter cut-away side-views showing some components of downhole flow control devices having self-triggering capability, according to some embodiments. Flow control devices 1520 and 1522 are similar in most respects or identical to inflow control devices 220 and 222 as shown in FIG. 2A, and can also operate in injection mode, according to some embodiments. Specific chemical tracer chemicals 1552 and 1554 are positioned as shown on the outer surface of the device as shown. The tracer chemicals are designed to be dissolved by or to react with the unwanted produced fluids such that the chemical is released into the produced fluid stream and can be detected on the surface thereby indicating the presence of the unwanted fluid at the particular device. Different chemical or unique chemical additives can be used to uniquely identify which device or devices through which the unwanted fluids are starting to flow into the wellbore. For example, for water control, the tracer chemical would be one in which water contacts it for a predetermined period, degrades and dissolves and can be detected on the surface (or elsewhere downstream).

According to some embodiments, the tracer chemical encapsulates a separate trigger chemical which flows with the production stream to the control device. In the example shown in FIGS. 15A-B, tracer chemical 1552 encapsulates trigger chemical 1528, and tracer chemical 1554 encapsulates trigger chemical 1530. The trigger chemical released is designed to trigger the actuation device, thereby automating the process of flow control. In the case of device 1520, trigger chemical 1528 dissolves a stop device in device 1520 such that the choke sleeve 226 slides to cover the choke orifices 224*a* and 224*b*. Thus an operator on the surface is notified via the tracer that a particular device is associated with the production of the unwanted fluid, and the device is automatically shut off by the encapsulated trigger chemical. Thus, the capability for automatically actuated downhole devices is provided without the intervention or pumping of a trigger chemical, according to some embodiments. This type of device could be considered an "autonomous" device as is generally understood by the industry.

According to some embodiments, the techniques of FIGS. 14A-B and 15A-B can be combined. For example, the indicator chemical 1450 can be included in the choke sleeves of the automatically triggered devices 1520 and 1522. Thus an operator on the surface would obtain confirmation that the automatically triggered device had in-fact been shut off.

While the subject disclosure is described through the above exemplary embodiments, it will be understood by those of ordinary skill in the art that modification to and variation of the illustrated embodiments may be made without departing from the inventive concepts herein disclosed. Moreover, while the embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A method of chemically targeting control of flow control devices installed in a wellbore comprising:

by an operator, selecting for actuation at least one of a plurality of flow control devices previously installed in a wellbore, leaving at least one of said plurality of flow control devices as non-selected for actuation;

selecting a triggering chemical fluid configured to selectively trigger actuation of said flow control devices selected for actuation and configured not to trigger actuation of said flow control devices non-selected for actuation;

flowing said selected triggering chemical fluid from a surface location through the wellbore and to expose both said flow control devices selected for actuation and said flow control devices non-selected for actuation to said triggering chemical fluid;

selectively triggering actuations of said flow control devices selected for actuation, said actuations being caused by one or more chemical reactions resulting from exposure with said triggering chemical fluid, leaving un-actuated said flow control devices non-selected despite being exposed to said triggering chemical fluid; and wherein the triggering chemical fluid dissolves a mechanical stop retaining a choking member actuated with one or more spring members.

2. The method according to claim 1 wherein the plurality of previously installed flow control device includes three or more flow control devices.

3. The method according to claim 1 wherein each of the previously installed flow control devices is an inflow control device that controls fluid flowing into the wellbore from a zone of a subterranean formation.

4. The method according to claim 1 wherein each of the previously installed flow control devices is an injection flow control device that controls fluid flowing from the wellbore into a zone of a subterranean formation.

5. The method according to claim 4 wherein the injection flow control devices are used for stimulation of the zone of the subterranean formation.

6. The method according to claim 4 wherein the injection flow control devices are used for fracturing of the zone of the subterranean formation.

7. The method according to claim 1 wherein the triggering chemical fluid flows through a flowline to each of the previously installed flow control devices, the flowline being separate from a production fluid flowline through which fluid produced from a subterranean formation flows into the wellbore.

8. The method according to claim 7 wherein actuation of said flow control devices selected for actuation acts to control an amount of undesirable fluid from entering the wellbore from a subterranean formation.

9. The method according to claim 8 wherein the undesirable fluid is water.

10. The method according to claim 8 further comprising analyzing fluid produced from the wellbore to identify a chemical tracer material that corresponds to a zone in the subterranean formation where the undesirable fluid is entering the wellbore, and wherein said flow control devices selected for actuation are selected so as to reduce fluid from the corresponding zone by actuation of the flow control devices selected for actuation.

11. The method according to claim 1 wherein one or more of the previously installed flow control devices include an indicator chemical that is released into the wellbore when the device is actuated, the indicator chemical being detectable on the surface thereby indicating confirmation of actuation of the device.

* * * * *